US007497752B2

(12) United States Patent
Field

(10) Patent No.: US 7,497,752 B2
(45) **Date of Patent: *Mar. 3, 2009**

(54) FIN ATTACHMENT SYSTEM AND METHOD

(76) Inventor: John Field, GPO Box 5695, Hong Kong (HK) 5695

( * ) Notice: Subject to any disclaimer, the term of this patent is extended or adjusted under 35 U.S.C. 154(b) by 0 days.

This patent is subject to a terminal disclaimer.

(21) Appl. No.: 11/692,282

(22) Filed: Mar. 28, 2007

(65) Prior Publication Data

US 2007/0218788 A1 Sep. 20, 2007

Related U.S. Application Data

(63) Continuation-in-part of application No. 11/300,642, filed on Dec. 13, 2005, now Pat. No. 7,198,532.

(60) Provisional application No. 60/654,338, filed on Feb. 18, 2005.

(30) Foreign Application Priority Data

Dec. 13, 2004 (AU) ..... 2004907054
Dec. 14, 2004 (AU) ..... 200407120
Feb. 8, 2005 (AU) ..... 2005100116

(51) Int. Cl.
*B63B 1/00* (2006.01)
*B63B 35/00* (2006.01)

(52) U.S. Cl. ..... 441/79; 114/127; 114/140

(58) Field of Classification Search ..... 114/127, 114/140; 441/74, 79
See application file for complete search history.

(56) References Cited

U.S. PATENT DOCUMENTS 5,464,359 A 11/1995 Whitty
5,672,081 A 9/1997 Whitty
5,830,025 A 11/1998 Fleming
6,139,383 A 10/2000 Jolly et al.
6,752,674 B2 6/2004 Jolly
6,793,548 B2 9/2004 Jolly et al.
6,991,503 B2 1/2006 Garcia (Continued)

FOREIGN PATENT DOCUMENTS

AU 199334088 A1 9/1993

(Continued)

OTHER PUBLICATIONS

International Search Report mailed Aug. 11, 2006.

(Continued)

*Primary Examiner*—Lars A Olson
(74) *Attorney, Agent, or Firm*—Nixon & Vanderhye P.C.

(57) ABSTRACT

A fin box for releasable attachment of a fin having at least one fin-tab, the fin box adapted for insertion into and retention within a water board, the fin box including: a generally elongate body provided with a substantially rectangular recess open at a first surface of the body, the recess extending to a base proximal to a second surface opposite the first surface, and the recess having a forward end and a rearward end; wherein the structure is provided with at least one angled threaded hole extending from the first surface of the body to emerge at a point within the recess between the first surface and the base of the recess.

29 Claims, 32 Drawing Sheets

U.S. PATENT DOCUMENTS

| | | | | |
|---|---|---|---|---|
| 6,991,504 | B1 | 1/2006 | English et al. | |
| 7,001,236 | B2 | 2/2006 | Blake, Jr. | |
| 7,198,532 | B2 * | 4/2007 | Field | 441/79 |
| 2003/0092333 | A1 | 5/2003 | McCausland et al. | |
| 2003/0124924 | A1 | 7/2003 | McCausland et al. | |
| 2006/0019559 | A1 | 1/2006 | Mair et al. | |
| 2006/0178061 | A1 | 8/2006 | Caldwell | |

FOREIGN PATENT DOCUMENTS

| | | | |
|---|---|---|---|
| AU | 199521660 | A1 | 11/1995 |
| DE | 40 38 517 | A1 | 6/1991 |
| EP | 0 834 451 | A1 | 4/1998 |
| WO | 00/32466 | | 6/2000 |
| WO | 01/70565 | | 9/2001 |
| WO | 03/018395 | | 3/2003 |
| WO | 03/095301 | | 11/2003 |
| WO | 2004/035377 | | 4/2004 |
| WO | 2006/021029 | | 3/2006 |

OTHER PUBLICATIONS

Written Opinion mailed Aug. 11, 2006.
Notification of International Search Report and The Written Opinion mailed Aug. 11, 2006.

* cited by examiner

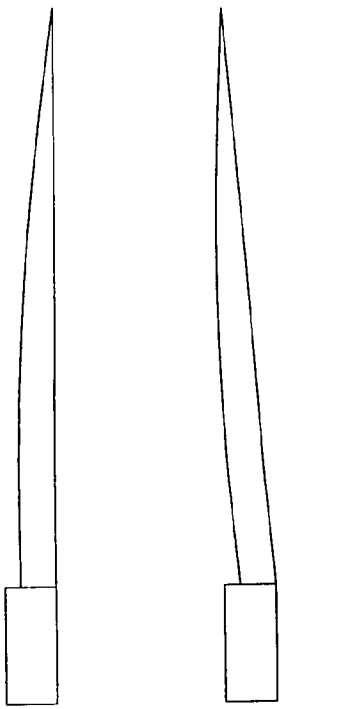
Fig. 11C
Fig. 11D
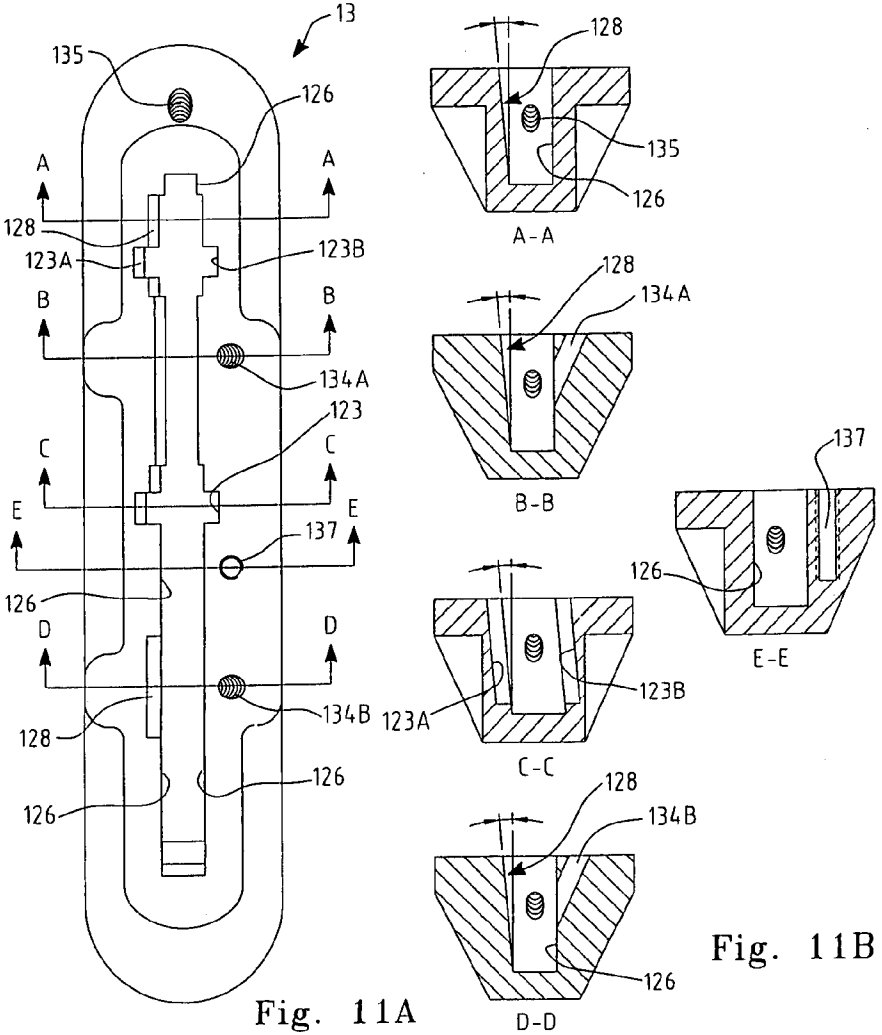
Fig. 11B
Fig. 11A

Sec B-B

Sec A-A

Sec C-C

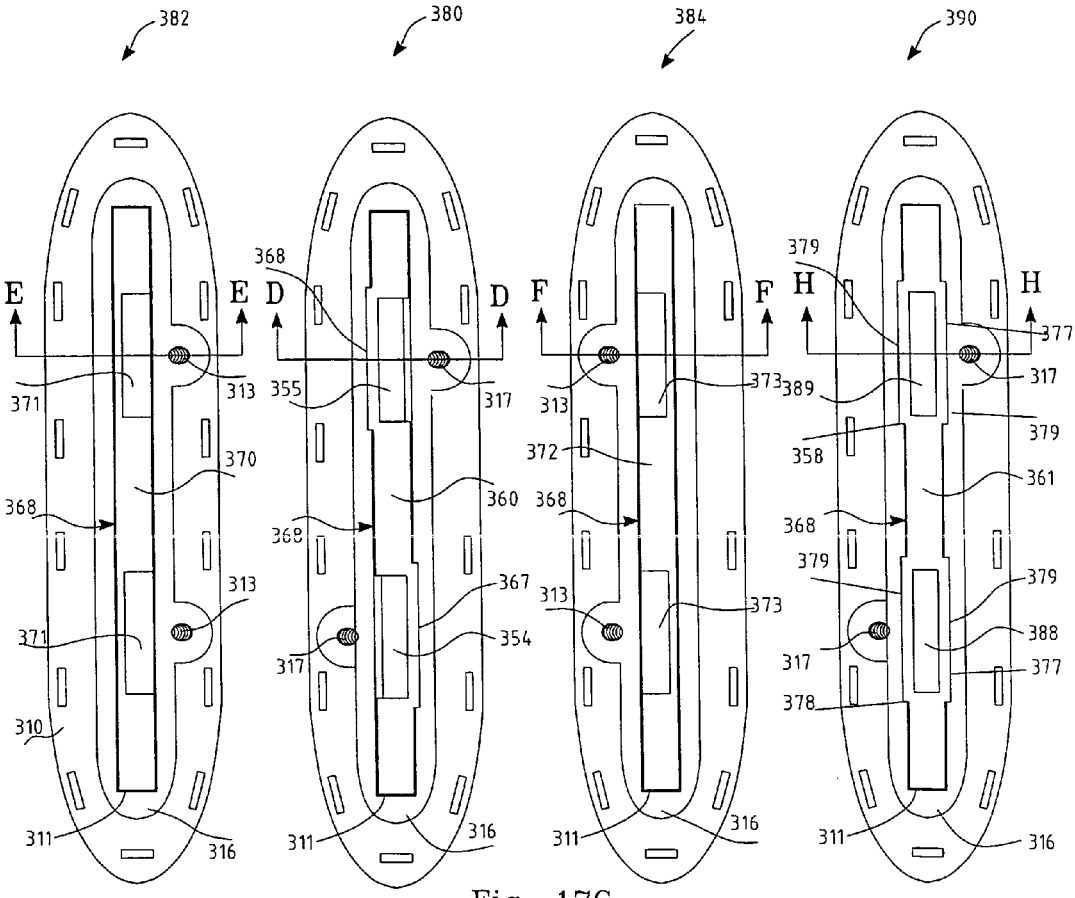
Fig. 17G
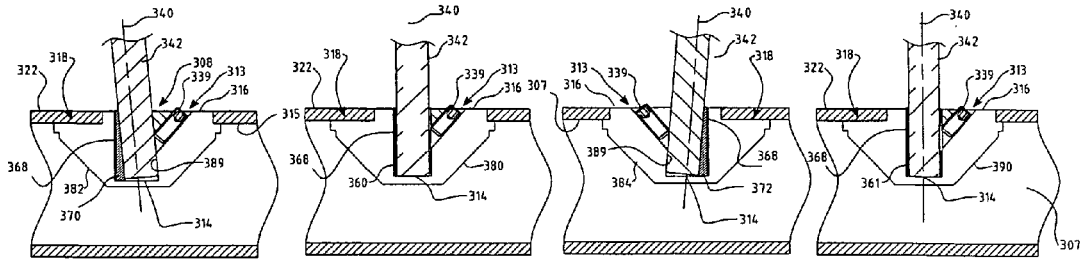
Sec E–E Fig. 17E Sec D–D Fig. 17D Sec F–F Fig. 17F Sec H–H Fig. 17H

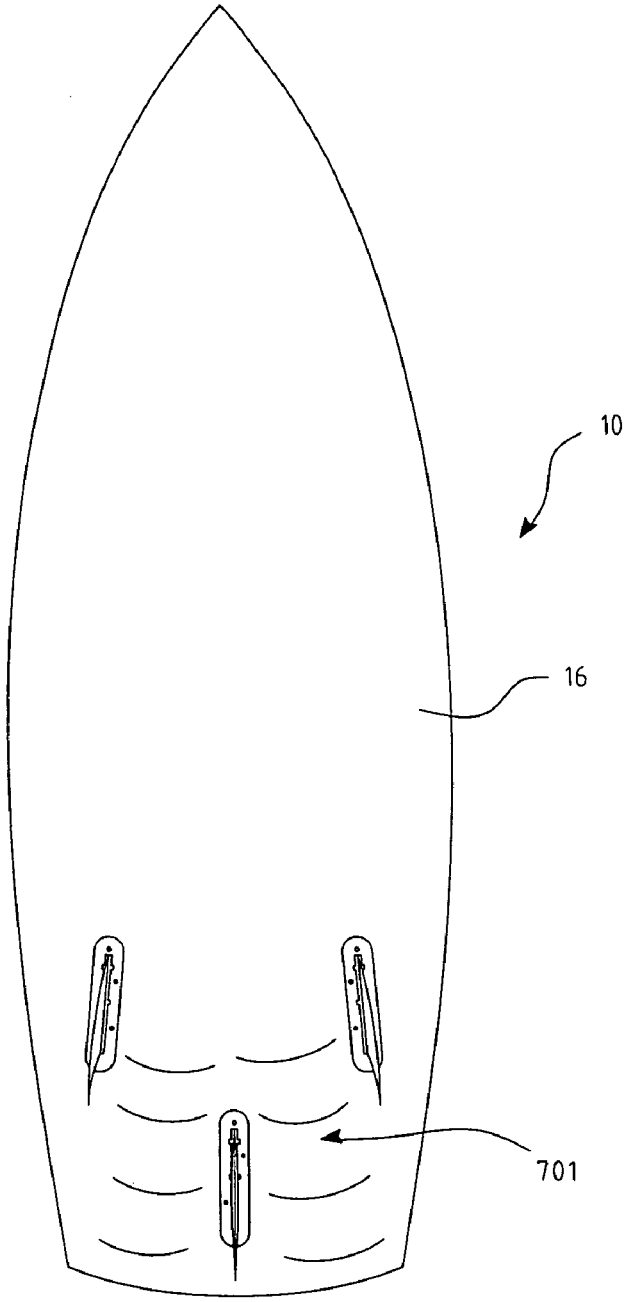
Fig. 24
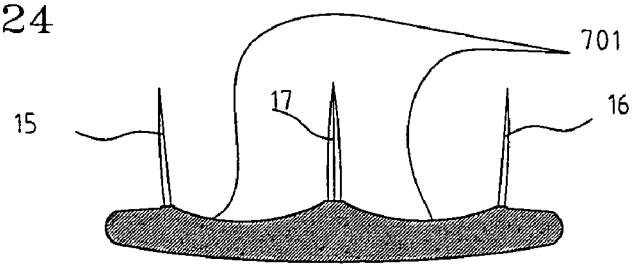

FIN ATTACHMENT SYSTEM AND METHOD

This application is a continuation in part (CIP) of U.S. patent application Ser. No. 11/300,642, filed Dec. 13, 2005, and claims the benefit of U.S. Provisional Application No. 60/654,338, filed Feb. 18, 2005, and also claims priority to Australian Provisional Application No. 2004907054, filed Dec. 13, 2004, Australian Provisional Application No. 200407120, filed Dec. 14, 2004, and Australian Innovation Application No. 2005100116, filed Feb. 8, 2005. All of the these identified applications are hereby incorporated in their entirety by reference herein.

BACKGROUND OF THE INVENTION

The present invention relates to fins and their attachment to small water craft and, more particularly to a system for attaching a variety of fin configurations to a surfboard.

As with many types of sporting equipment, many variations on the basic article have been developed to tailor the article to the preferences of the user and the conditions of use. So it is with the fins attached to the rear undersides of surfboards.

It is an obvious advantage for the owner of a board to be able to interchange the fin or fins both to experiment, with the aim of finding the fin most suited to their body weight and style of riding, and from time to time to suit the conditions in which the board is to be ridden.

Interchangeable fin systems are known and comprise of a selection of fins retained in a so-called fin box. Particular examples may be found in U.S. Pat. Nos. 5,830,025, 5,975,974 and WO 01/70565. The fin box is generally a permanent fixture built into the body of the board during its manufacture and, again generally includes a slot or slots into which the tab or heel of the fin may be inserted. The means for retaining an inserted fin securely in the fin box are many and varied, ranging from relatively simple snap-in systems to arrangements incorporating fasteners requiring the application of tools to install and remove a fin from its fin box. A disadvantage with these systems is that the fin box is designed to take only one configuration of a fin tab, so that the owner of a board who wishes to change or experiment with a variety of fins from manufacturers other than the manufacturer of his or her board, or at least the fin boxes fitted to the board, is restricted in choice.

BRIEF DESCRIPTION OF THE INVENTION

A fin box is disclosed for releasable attachment of a fin having at least one fin-tab, said fin box adapted for insertion into and retention within a water board, the fin box comprising: a generally elongate body provided with a substantially rectangular recess open at a first surface of the body, said recess extending to a base proximal to a second surface opposite said first surface, and said recess having a forward end and a rearward end; wherein said structure is provided with at least one angled threaded hole extending from said first surface of said body to emerge at a point within said recess between said first surface and said base of said recess.

A method is disclosed for releasable attachment of a fin of a water board, said method including: (a) providing at least a fin box embedded in said water board, said fin box comprising an elongate body with a recess longer than a length of a portion of the fin to be inserted into the recess, (b) withdrawing a screw provided in an angled threaded hole in said fin box to allow insertion of said portion of the fin into said recess, (c) adjusting the fin forward or aft in the recess to position the portion of the fin in the recess; (d) driving said screws into contact with the portion of the fin while said fin is in the recess.

A fin box is disclosed for a water board, said fin box comprising: a generally elongate body provided with a substantially elongated recess open at a first surface of said body; a peripheral flange extending outwardly from said elongate body at said first surface; a buttress along at least one side of said elongate body, the buttress portions forming a projecting abutment between a said flange opposite and said at least one side of said elongate body; an angled hole extending through the flange, the buttress and through said at least one side of said elongate body, and a shaft seated in the angled hole and adapted to abut a side of a fin inserted in the recess of the fin box, wherein the shaft secures the fin to the fin box and water board when seated in the angled hole and abutting the fin.

A fin box is disclosed for a water board, said fin box comprising: a generally elongate body provided with a substantially elongated recess open at a first surface of said body, wherein the recess is adapted to receive an end portion of a fin; an angled hole extending through the first surface and through said at least one side of said elongate body, and a shaft seated in the angled hole and adapted to abut a side of a fin inserted in the recess of the fin box, wherein the shaft secures the fin to the fin box and water board when seated in the angled hole and abutting the fin.

BRIEF DESCRIPTION OF THE DRAWINGS

Embodiments of the present invention will now be described with reference to the accompanying drawings wherein:

FIG. 11A is a plan view of a left side fin box;

FIG. 11B is a series of cross sections taken along the length of the fin box of FIG. 11A;

FIG. 11C is an end view of a side fin with an inline fin-tab;

FIG. 11D is an end view of a side fin with a canted fin-tab;

FIGS. 17D, 17E 17F and 17H are sectioned end views of an alternative arrangement of the center, left and right fin boxes of FIG. 17;

FIG. 17G shows plan and end views of a further preferred embodiment of a left, right and center fin boxes;

FIG. 24 is a view of the underside of a surfboard fitted with the concave channels between the center fin and the side fins;

DETAILED DESCRIPTION OF THE INVENTION

First Preferred Embodiment

Figure 1:
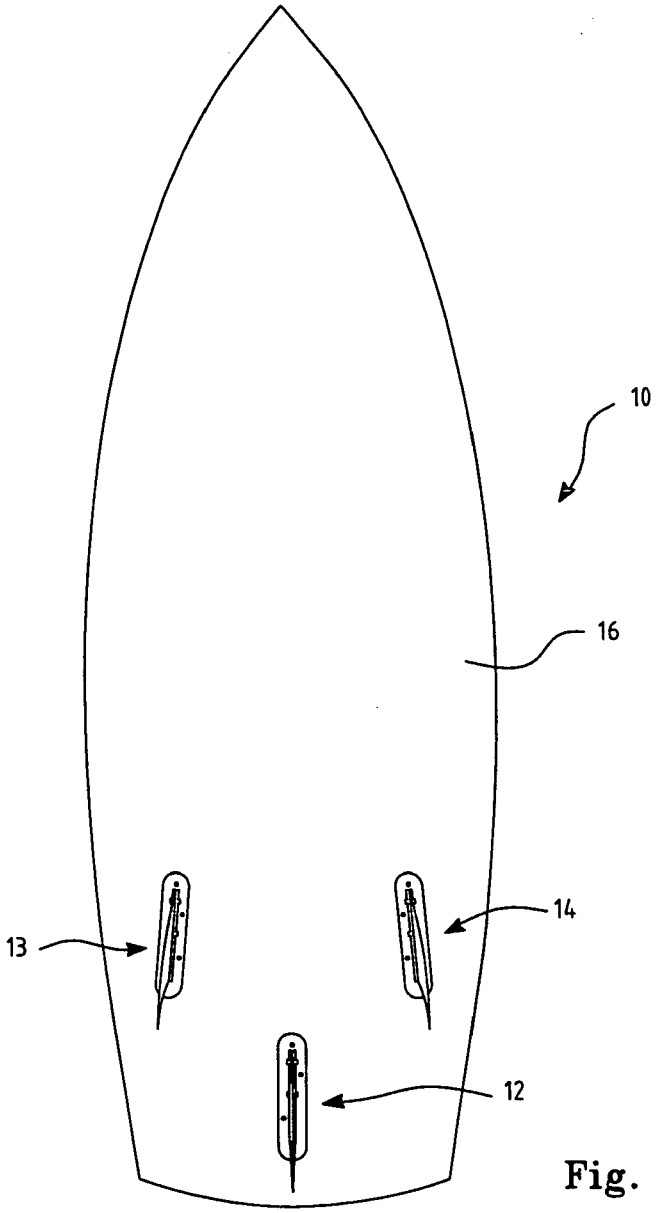
FIG. 1 is a view of the underside of a surfboard fitted with the fin attachment system for a typical three fin arrangement.
Figure 2:
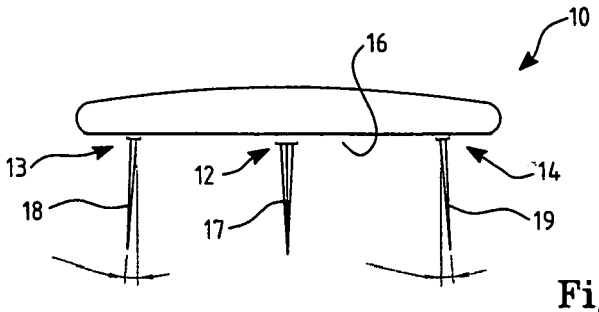
FIG. 2 is an end view of the surfboard of FIG. 1 showing a center and left and right fins.

In a first preferred embodiment of the invention and with reference to FIGS. 1 and 2, a surfboard 10 is fitted with three fin retaining structures 12, 13 and 14, commonly known as fin boxes, embedded into the underside 16 of surfboard 10. Fin box 12 provides for a center fin 17, while fin boxes 13 and 14 accommodate left outside fin 18 and right outside fin 19 respectively.

Fins 17, 18 and 19 are held in retaining structures of fin boxes 12, 13 and 14 by a fin-tab formed at the top edge of the fin, that is that edge of the fin substantially flush with the surface of the underside of the surfboard. Examples of typical fins and fin-tabs commercially available are shown in FIG. 3.

Referring again to FIG. 2, it will be noted that while center fin 17 has its central plane normal to the underside 16 of surfboard 10, the left and right outside fins are canted outwardly relative to that plane. That canting is generally at an angle of 5 degrees. Canting of outside fins may be introduced either by introducing the cant angle within the recess of the left and right fin boxes, or by the canting of the plane of the fin relative to the fin-tab. The fin boxes 13 and 14 of the present invention provide for canting of outside fins which have the fin-tab in-line (that is, no canting of the fin-tab), as well as allowing the use of outside fins canted relative to the fin-tab, as will be explained in more detail below.

Figure 4:
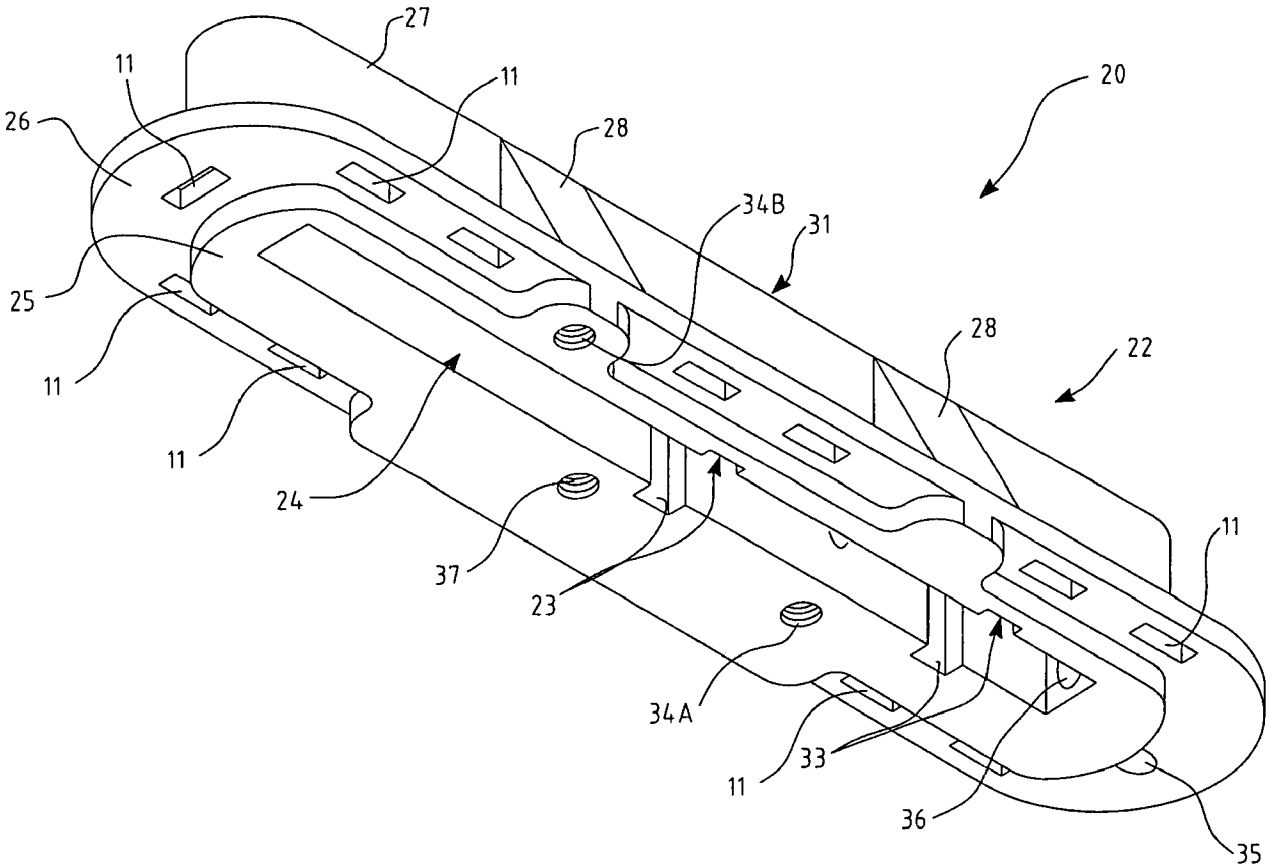
FIG. 4 is a perspective view from below of a center fin-box.
Figure 5:
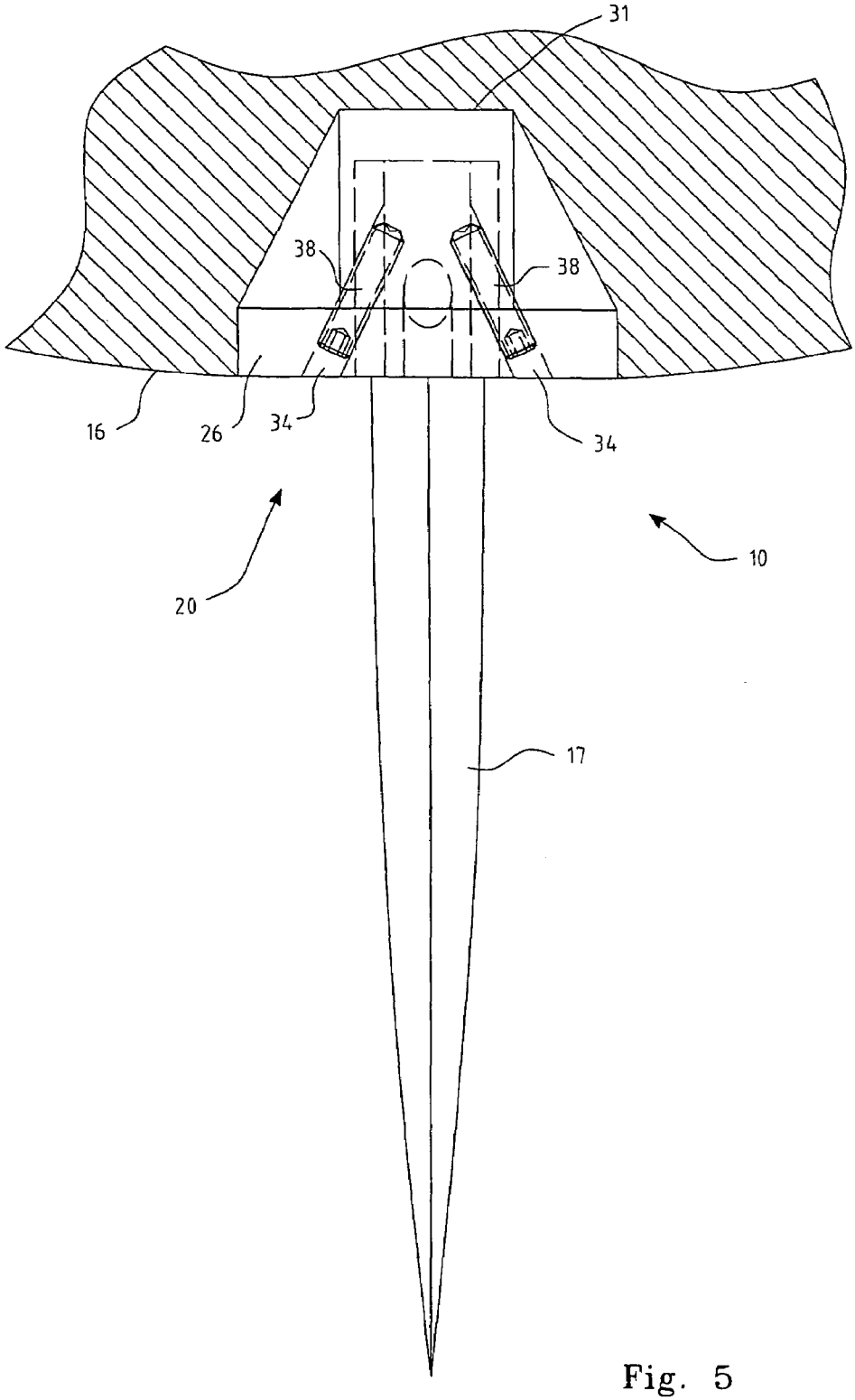
FIG. 5 is a cross section view of the fin box of FIG. 4 with a fin retained in the fin box.

Turning now to the specific structures of a preferred embodiment of fin boxes according to the invention for center and outside fins able to accept a multiplicity of commercially available fins, both with in-line and canted fin-tabs. With reference to FIG. 4 a center fin box 20 is constructed as a generally elongate body 22 provided with a recess 24. Body 22 has a first surface 25 which, when fin box 20 is installed in the body of a surfboard (as shown in FIGS. 1 and 5) is generally flush with the fiber glass surface of the underside 16 of the board 10. First surface 25 includes a peripheral flange 26 extending outwardly from the body 22. Peripheral flange 26 is generally flush with the surface of the foam core of the board, and can be of a profile independent of the profiles of the recess 24 or first surface 25.

Figure 3:
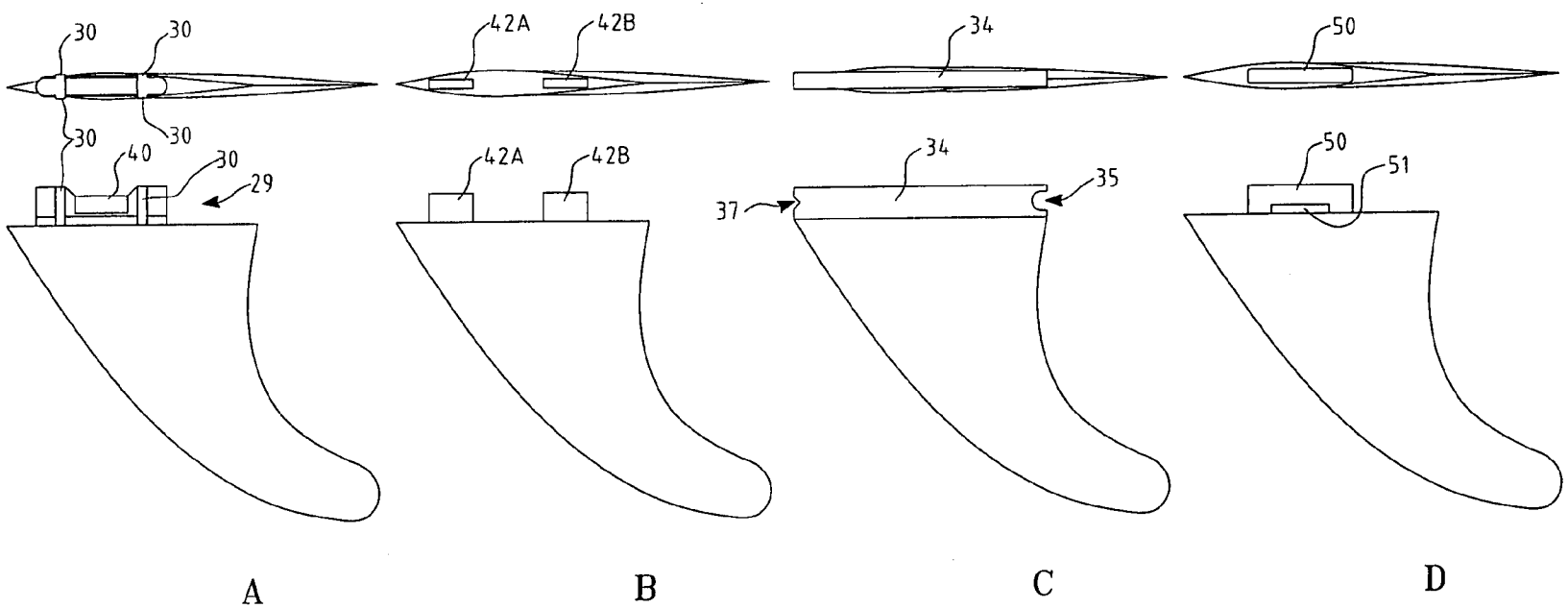
FIG. 3 shows side views and plan views of four fin and fin-tab configurations able to be fitted to a preferred embodiment of the fin attachment system, or fin box of the present invention.
Figure 6:
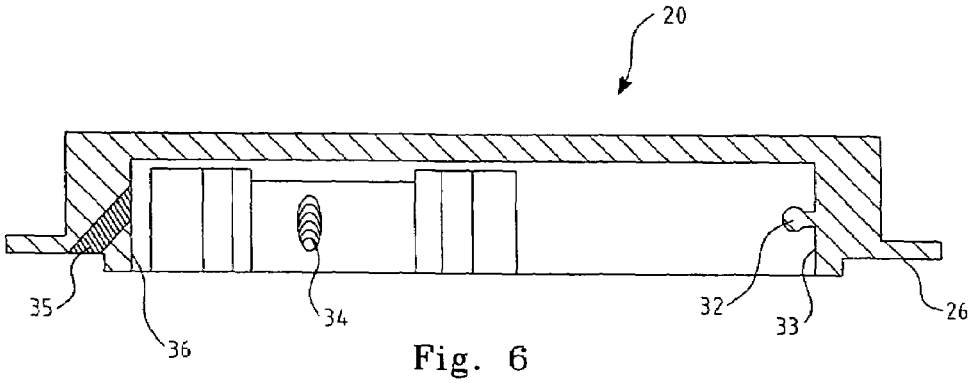
FIG. 6 is a side cross section view of the fin box of FIGS. 4 and 5.
Figure 7:
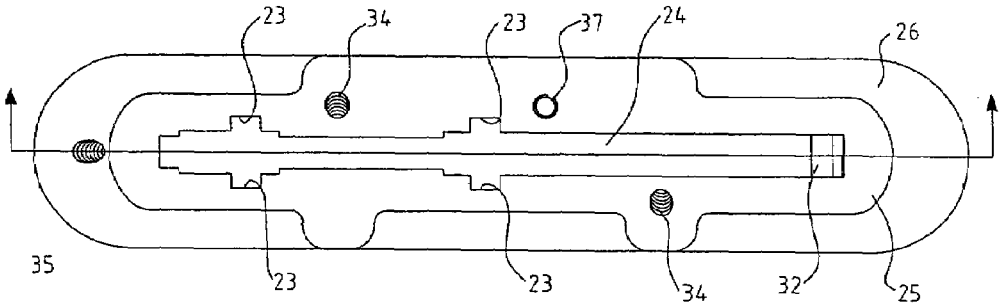
FIG. 7 is a plan view of the fin box of FIG. 6.
Figure 9:
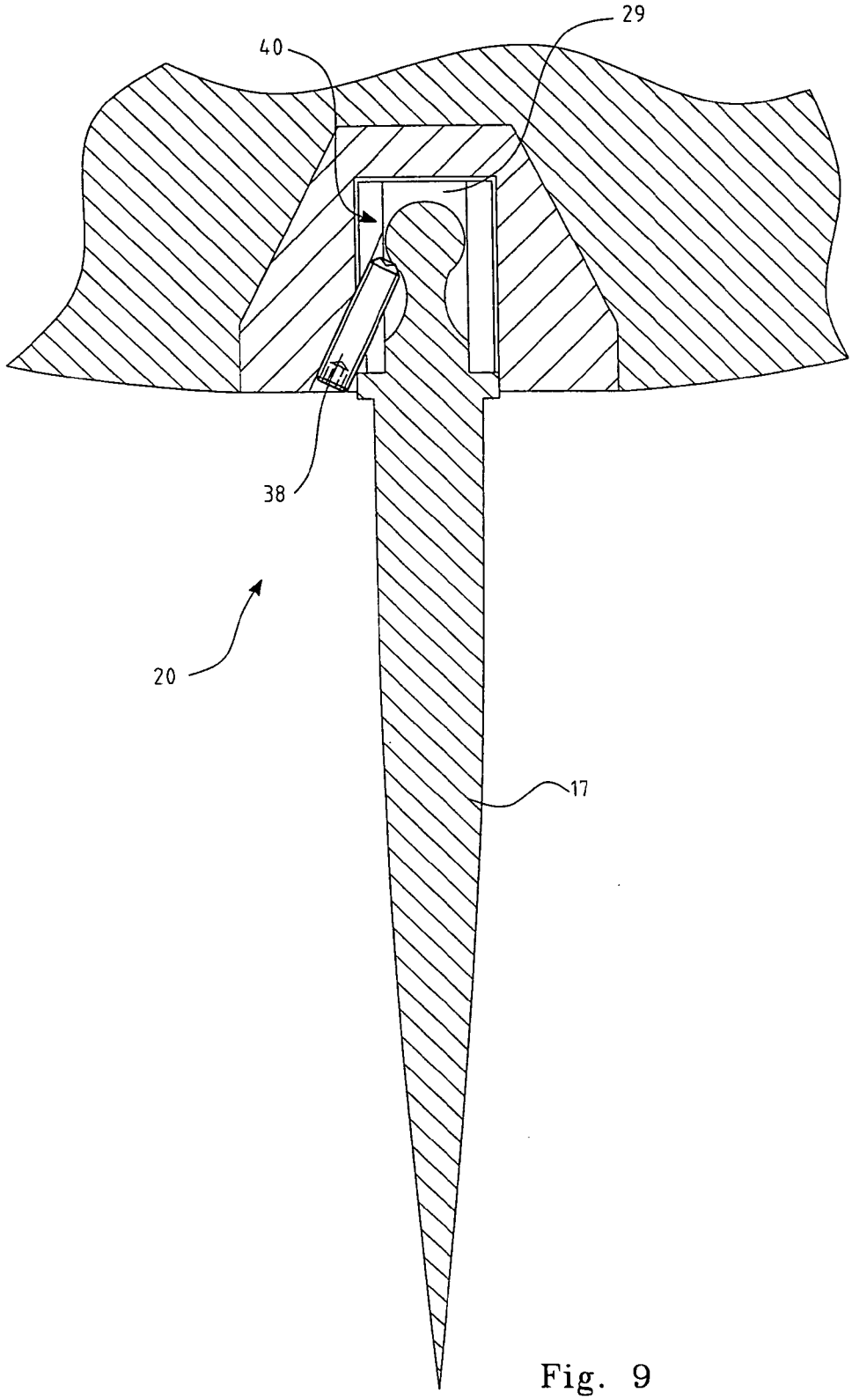
FIG. 9 is a sectioned end view of the fin box of FIGS. 6 and 7 when fitted with fin 3A of FIG. 3.

Recess 24 extends into the body to a depth sufficient to accept any of the fin-tabs of the commercially available fins shown in FIG. 3. As best seen in FIGS. 4 and 5, body 22 is further provided with a pair of buttress portions 28 at each side of body 22, extending from the underside of flange 26 to the side surface 31. Angled threaded holes 34A and 34B are provided along each side of recess 24, passing from surface 25 to emerge at inside surfaces of the recess as best seen in FIGS. 5, 6 and 7. Angled threaded holes 34A and 34B coincide with the buttress portions 28. A further angled threaded hole 35 emerges at the forward inside end wall 36 of recess 24. A vertical threaded hole 37 is also provided as shown in FIGS. 4, and 7. The width and configuration of the recess is such as to allow insertion of the fin-tabs shown in FIG. 3. Thus for example, the lateral recesses 23 extending outwardly from the main recess 24 are adapted to accept the projecting elements 30 of fin-tab 29 of fin 3A in FIG. 3. As can be seen in FIG. 9 the fin-tab of fin 3A may be securely retained in recess 24 of fin box 20 by a setscrew 38 driven into the angled threaded hole 34A on one side of recess 24 and engaging with cylindrical portion 40 of the fin-tab.

Figure 8:
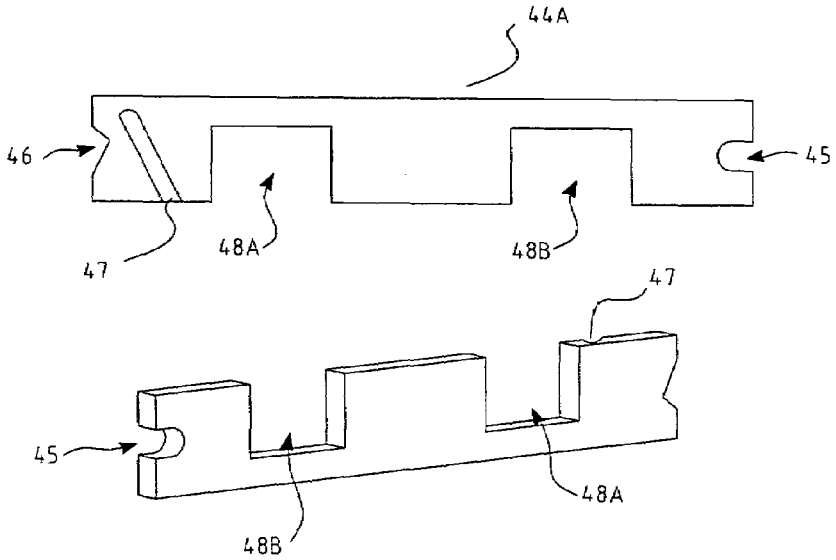
FIG. 8 is a side and perspective view of an insert for use with the fin box of FIGS. 6 and 7.
Figure 8A:
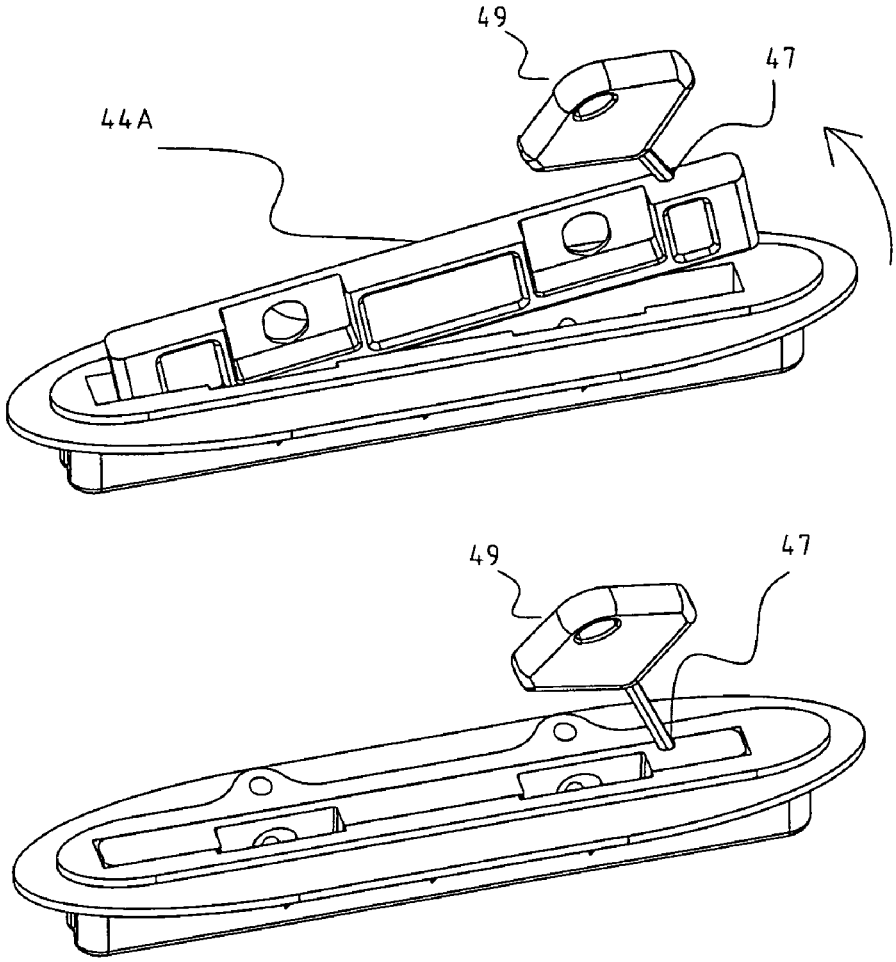
FIG. 8A is a perspective view of an insert being removed from a finbox with a tool inserted in an extraction cavity.
Figure 10:
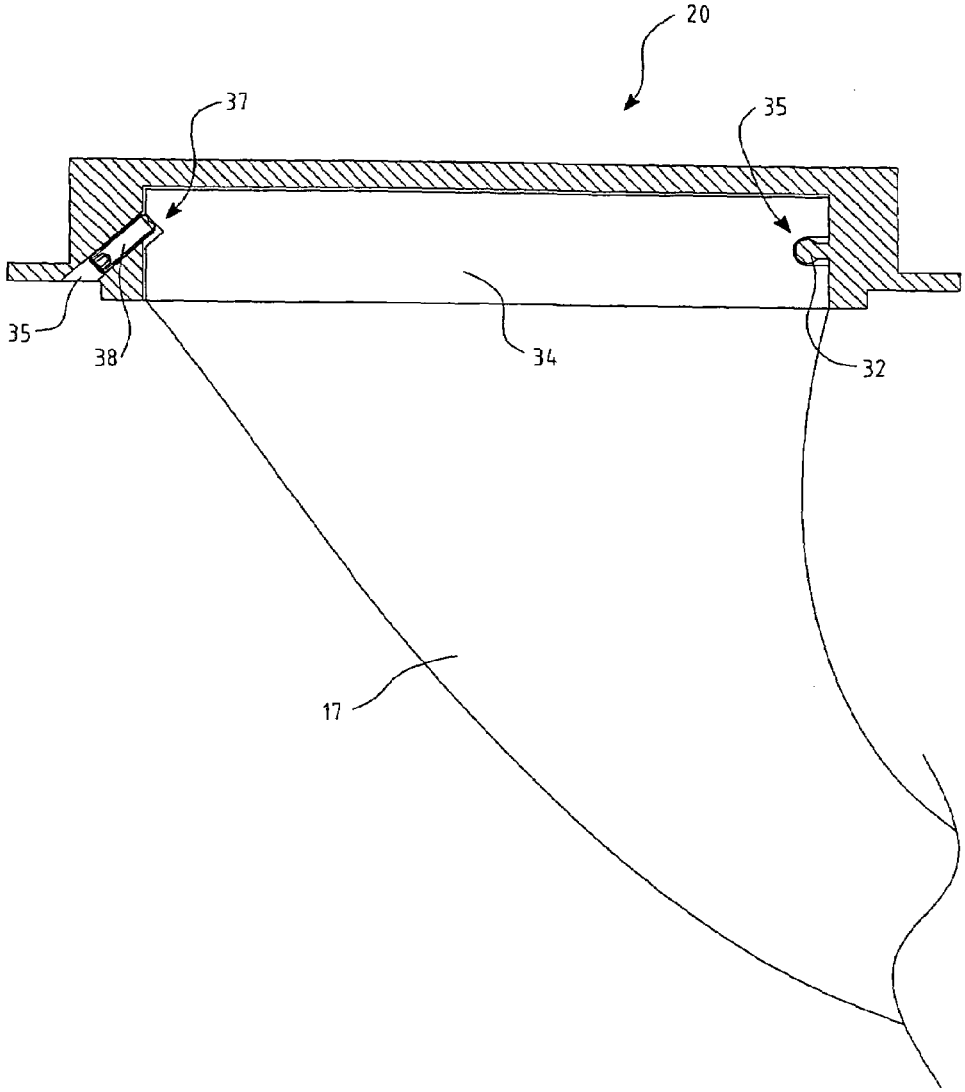
FIG. 10 is a sectioned side view of the fin box of FIGS. 6 and 7 when fitted with fin 3C of FIG. 3.

With reference to FIGS. 6 and 7, recess 24 is provided with a retention member 32 extending across the width of recess 32 and projecting from the rearward end wall 33 of recess 24. Retention member is adapted for engagement with a rear notch 35 in the fin-tab 34 of fin 3C (shown in FIG. 3). As shown in FIG. 10, fin-tab 34 of fin 3C is retained in fin box 20 at the rear by the engagement of notch 35 with retention member 32, and at the front by setscrew 38 engaging front notch 34. Additionally, setscrews 38 (not shown in FIG. 10), may be driven through angled threaded holes 34A and 34B against the sides of fin-tab 34. The fin 3B shown in FIG. 3 has a fin-tab made up of two sections 42A and 42B. To accommodate this fin-tab in the fin box of the present embodiment of the invention, there is provided an insert 44A shown in FIG. 8. Insert 44A is of similar external dimensions as the fin-tab 34 of fin 3C, and is provided with similar rear notch 45 and front notch 46 to enable the insert 44A to be retained in fin box 20 by retention member 32 and the set screw through front threaded hole 35. Insert 44A is further provided with at least one extraction cavity 47, located within the body, of the insert, such cavity open to any exposed surface of the insert when embedded into the recess 24, to allow for the insertion of a tool 49, to aid in the removal of the insert, by levering it from the fin box recess as shown in FIG. 8A. Insert 44A is further provided with cutout portions 48A and 48B, sized to receive fin-tab sections 42A and 42B. These sections are then secured in fin box 20 by setscrews driven through angled threaded holes 34A and 34B with the setscrews driving up against the sides of fin-tab sections 42A and 42B.

Figure 15:
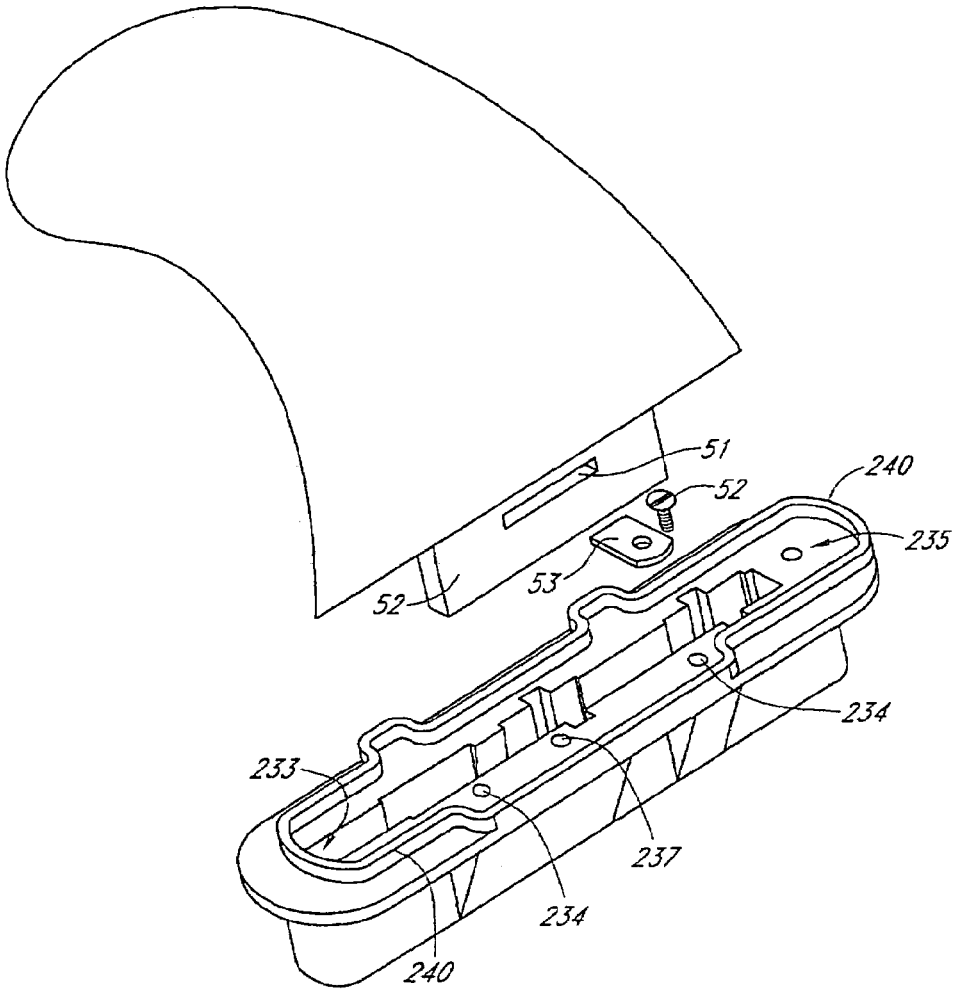
FIG. 15 is a perspective view of the fin box of FIG. 4 showing a further retaining system for fin 3D of FIG. 3.
Figure 16:
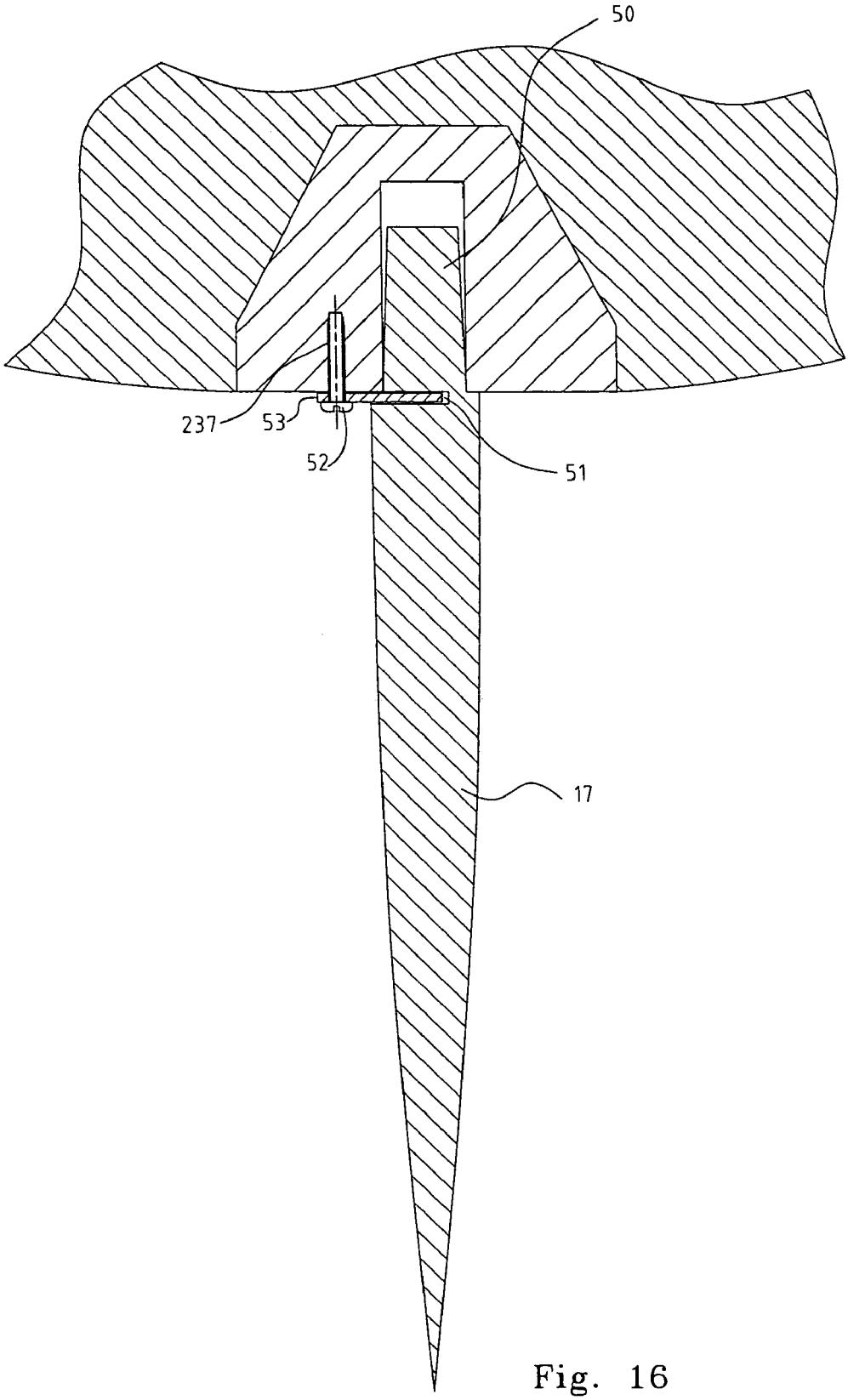
FIG. 16 is a sectioned end view of fin 3D retained in the fin box of FIG. 4.

With reference to FIGS. 15 and 16, fin 3D (shown in FIG. 3), has a fin-tab 50 with slot 51 at the interface between the fin and the tab. This fin, once inserted into the recess 24 of the fin box, is retained by a plate 53 inserted into slot 51 and secured to the fin box by screw 52 screwed into vertically threaded hole 237.

The side fin boxes 13 and 14 are of similar configuration to that of the center fin box thus far described, but have recesses that are somewhat modified. The left and right fin-boxes are of symmetrical configuration and only the left fin box will be described in detail. FIG. 11A shows a plan view of the flanged face of a fin box 13 for the left fin of a three-fin surfboard. The recess 124 of this box has sections 128 of the inside wall of the recess closest to the outside edge of the surfboard (to the left in FIG. 11A) sloping outwardly by 5 degrees as indicated by the sectional views A-A to D-D in FIG. 11B. The opposing end walls 123A and 123B of lateral recesses 123 which extend outwardly from main recess 124, slope inwardly so as to be parallel to the modified sloping wall sections of the recess 124 towards the outside edge of the surfboard, as can be seen in section C-C. The outward sloping sections 128 at A-A to D-D are so placed within recess 124 as to accommodate side fin configurations with in-line fin-tabs such as shown in FIG. 11C and canted fin-tabs as shown in FIG. 1D. Of the fin-tab configurations shown in FIG. 3, which may be accommodated in the fin box of the present invention, fins 3A and 3B have in-line fin-tabs for both left and right fins, while fin 3C and fin 3D have fin-tabs canted by 5 degrees for the left and right outside fins. It will be seen from the placement of the outwardly sloping sections 128 of recess 124 in FIGS. 11A and 11B, that in-line fin-tab 29 of fin 3A when inserted into recess 124, will be canted outwardly by 5 degrees, since all the vertical faces of that fin tab will slide into those sections at A-A, B-B and C-C which have the side surfaces sloping at 5 degrees.

Figure 13:
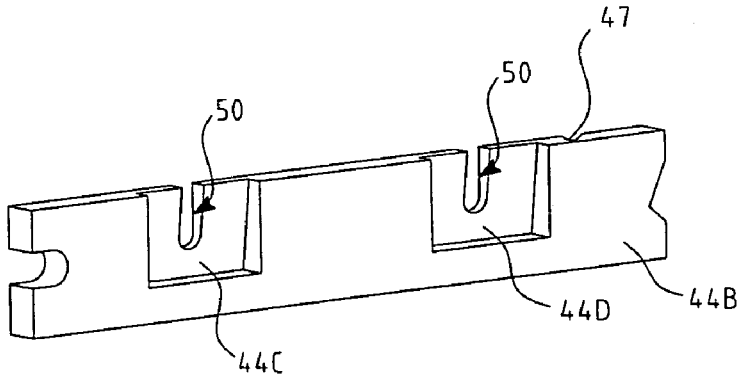
FIG. 13 is a perspective view of an insert for use in the fin box of FIG. 11A.
Figure 14:
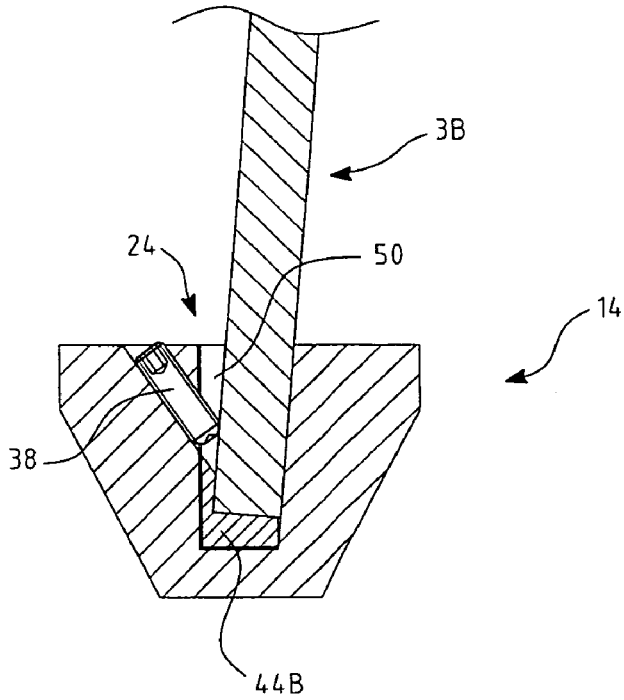
FIG. 14 is sectioned view of a fin inserted in the fin box of FIG. 11A with the insert of FIG. 13.

Likewise, the fin-tab configuration of fin 3B will be accommodated at sections B-B and D-D, when combined with the insert 44B of FIG. 13 as previously described, but which, for this insert has a 5 degree cant built into cutout portions 44C and 44D. FIG. 14 shows fin 3B located in recess 24 with insert 44B, and locked in place by a set-screw through angled threaded hole 135.

Fin tab 34 of fin 3C, and fin-tab 50 of fin 3D however need to be retained in the fin box without the 5 degree cant. This is achieved by the remaining sections 126 of recess 124, which retain parallel vertical walls.

As well, fin box 13 is provided with one pair of angled threaded holes 134A and 134B only along that side of the recess 124 away from the outside edge of the surfboard (that is to the right in FIG. 11A). Thus the in-line fin-tabs 29 of fin 3A is driven by the set screws through holes 134A and 134B into the desired canted position within recess 124, against the sloping side surfaces towards the outside of the surfboard.

With reference again to FIGS. 13 and 14, the in-line fin tabs 42A and 42B of fin 3B are positioned at the 5 degree cant by inserting the fin-tabs into the recess portions 44C and 44 D of insert 44B. The fin-tabs are then secured by setscrews 38 that pass through slots 50 in recesses 44C and 44D to drive the fin-tabs against the outwardly sloping side surfaces of recess 24 and so canting the fin towards the outside edge of the surfboard by 5 degrees. Fin-tab 34 of fin 3C, and fin-tab 50 of fin 3D, are retained in the normal vertical orientation as previously described for the center fin box.

Figure 12:
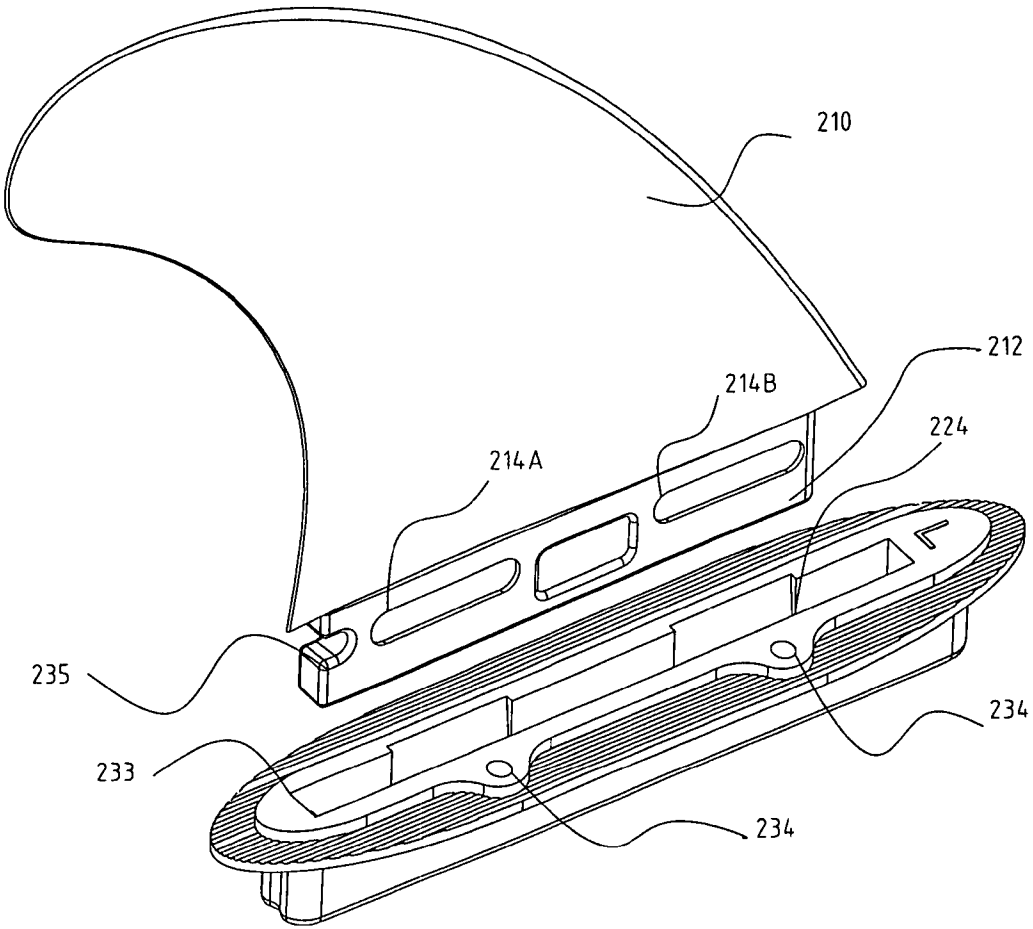
FIG. 12 is a perspective view of a preferred form fin box according to the invention with an adjustable fin.

The center, left and right fin boxes of the present invention as described above are further able to accept and retain an adjustable fin. As shown in FIG. 12, an adjustable fin 210 is provided with a shortened fin-tab 212. Preferably, fin tab 212 is 20 mm shorter than recess 224, so that fin 210 may be moved forward or rearward by 10 mm from a median position. Fin-tab 210 can be provided with notch 235 so as to allow the fin-tab to be located up against the rear wall 233 and not interfere with the retention member (32 in FIGS. 6 and 7) when located in its rearmost position. However, fin-tab 212 does not rely for retention in recess 224 on the retention member, nor on the forward setscrew in angled threaded hole 235. In this embodiment, the fin-tab 212 of fin 210 is provided with recesses 214A and 214B.

For a left side fin (as shown in FIG. 12) or right side fin box, both recesses are on one side of the fin-tab, that is, on that side on which the angled threaded holes 234 are positioned. For a center fin, the recesses are provided one on each side of the tab to correspond with the equivalent angled threaded holes of a center fin box as described herein above. The length of recesses 214 is such as to permit the setscrews driven through angled threaded holes 234 to engage with the recesses regardless of the user's preferred position of the fin.

Second Preferred Embodiment

In a further preferred embodiment of the invention, the fin boxes are somewhat simplified from those described above and shown in FIGS. 6 to 8 and FIGS. 11 and 12. In this embodiment the left, right and center fin boxes cater for fins with the fin tab configurations of FIGS. 3B and 3C.

Figure 17:
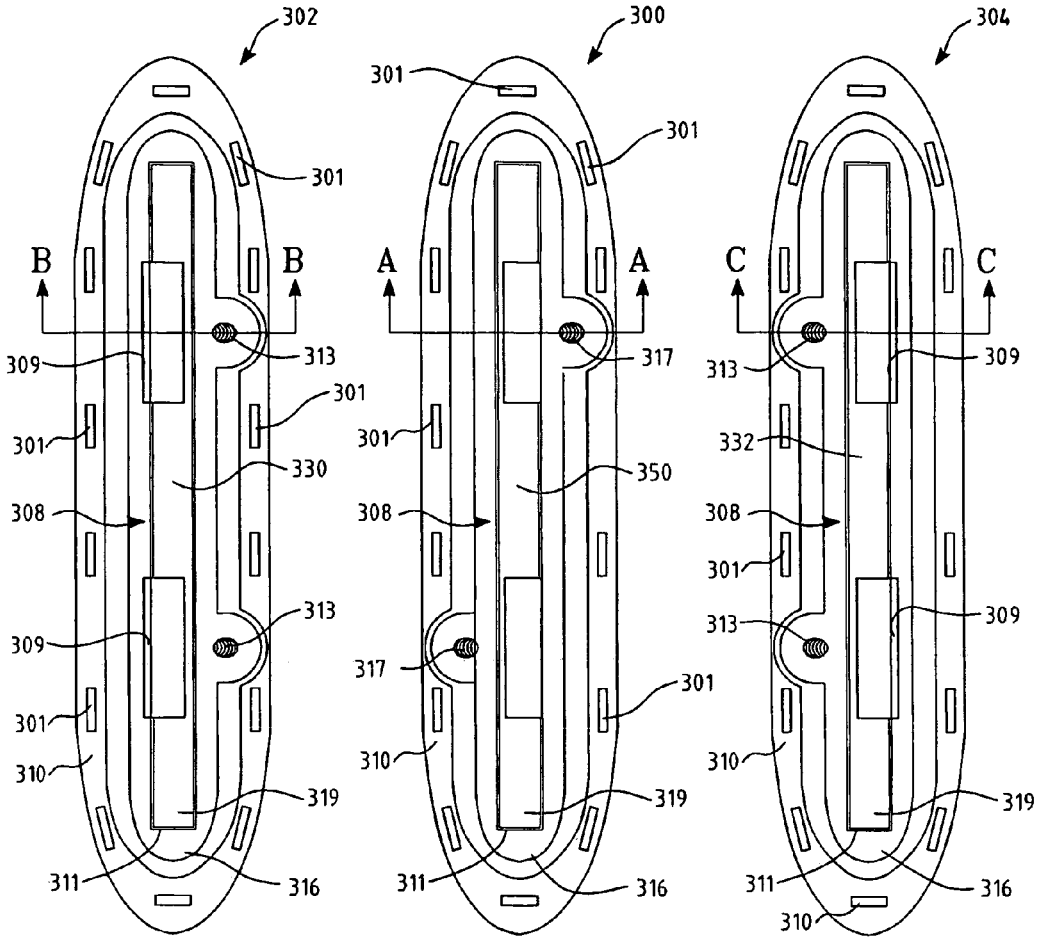
FIG. 17 shows plan and end views of a further preferred embodiment of a left, right and center fin box.
Figure 17B:
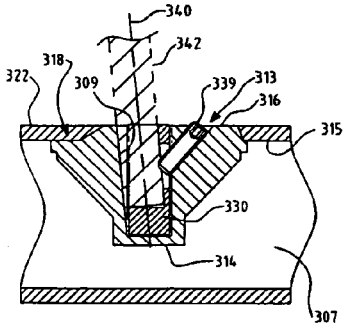
FIGS. 17A, 17B and 17C are sectioned end views of the center, left and right fin boxes of FIG. 17.

With reference to FIG. 17, a center fin box 300, right hand fin box 304 and left hand fin box 302 (as viewed in FIG. 17) are each formed as before, as an elongate body 306 provided with a central recess 308 and a peripheral flange 310. As can be seen in the sectioned views of each of FIGS. 17A to 17C, recesses 308 extend from a first outer surface 316 to proximate an opposite inner surface 314. Shown as dashed lines in FIG. 17, and as best seen in FIG. 18, the recess 308 of this embodiment is also provided with a retaining structure 319 projecting from the rearward end wall 311.

Figure 4A:
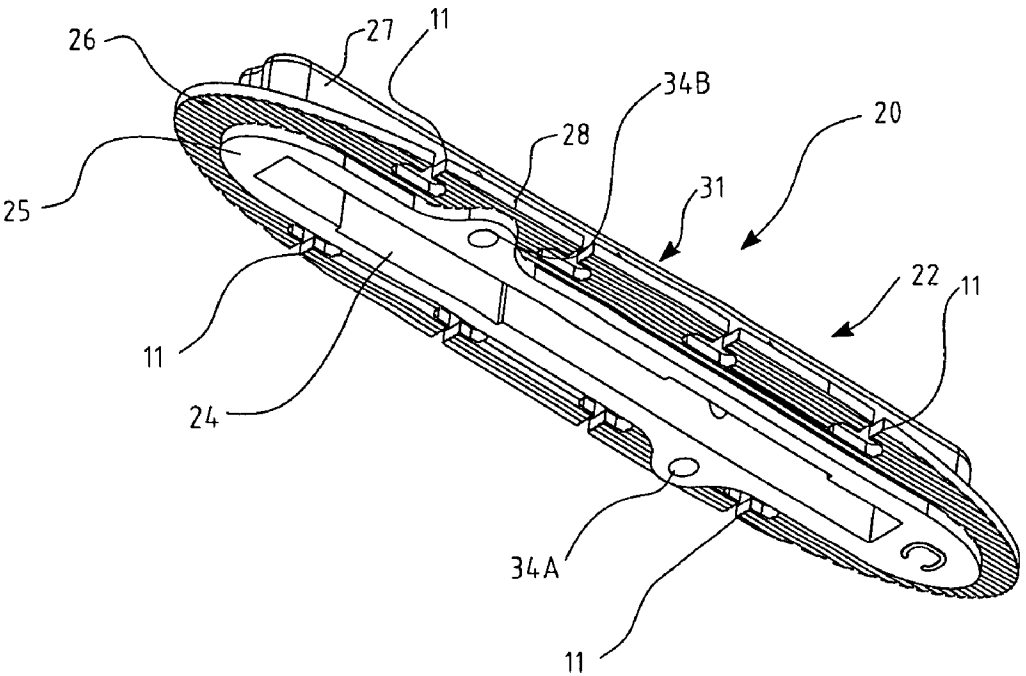
FIG. 4A is a further perspective view from below of a fin box with a modified form of perforations and grooved surface provided around the flange of the fin box.

First outer surface 316 comprises a first inner portion of peripheral flange 310 around recess 308. An outer portion 318 of flange 310, is offset from first outer surface 316. As can be seen in FIGS. 17, 17A, 17B and 17C, the offset between first outer surface 316 and the outer portion 318 of flange 310 is such that when the fin boxes are installed in the body of a surfboard, the surface of outer portion 318 is flush with the surface 315 of the foam core 307 of a surfboard and the first outer surface 316 is then flush with surface 322 of the finished outer fiberglass skin 320 of the underside surface 322. The outer portion of the peripheral flange 310 is provided with a plurality of apertures, 301 distributed at intervals around the recess 380 (as also shown in FIG. 4 around recess 24). These apertures are adapted to allow passage through the apertures of resin or bonding agent and any trapped air thereby increasing the retention strength of the fin box to the foam core of a surfboard when lateral and axial forces act on a fin inserted in the fin box. FIG. 4A shows the provision of an alternative form of perforations and surface grooves to the flange 310 that increase the bonding strength of the flange to the external fiber glass skin.

The length and breadth of first outer surface 316 which, though flush with the surface 322 of the surfboard, remains exposed, is such that no part of a fin installed in a fin box 300, 302 or 304 is in contact with the underside surface 322. The fin blade is thus fully supported by and within the extent of first outer surface 316. With reference to FIGS. 17, 17B and 17C, the right hand fin box 304 and left hand fin box 302 of this embodiment are each provided with two outwardly sloping wall sections 309. Outwardly sloping wall sections 309 of fin boxes 302 and 304 slope towards the right hand side and left hand side respectively of a surfboard. The length and disposition of sloping wall sections 309 conforms to the length and spacing of the dual fin-tabs 42A and 42B of the fin-tab configuration "B" of FIG. 3. Provided opposite each sloping wall section 309 is an angled threaded hole 313 passing from first outer surface 316 to the adjacent sidewall of recess 308.

Figure 17A:
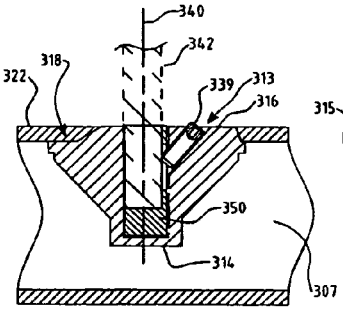
Figure 17C:
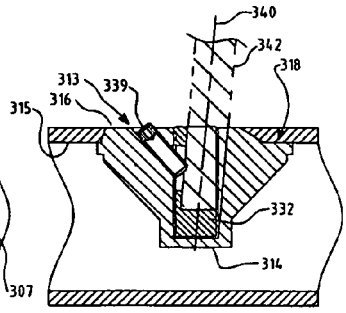
Figure 18:
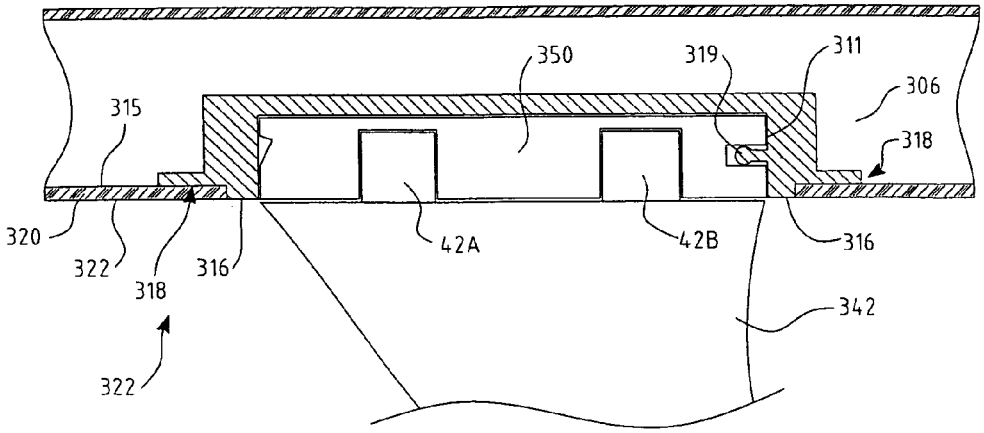
FIG. 18 is a sectioned side elevation view of one of the fin boxes of FIGS. 17, and 17A to 17C with a dual fin-tab fin installed together with insert.
Figure 18A:
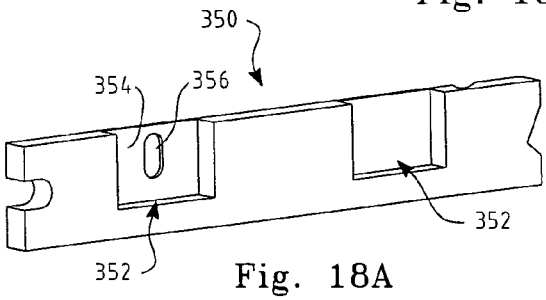
FIGS. 18A, 18B and 18C are detailed perspective views of inserts for the center, left and right hand fin boxes of FIGS. 17 and 17A to 17C.
Figure 18B:
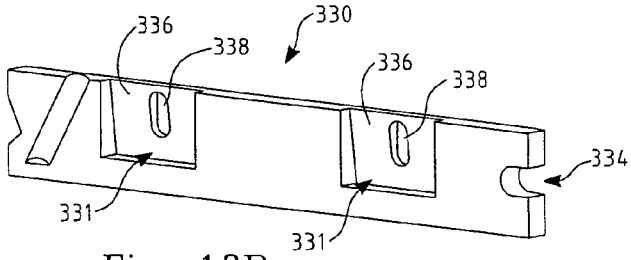
Figure 18C:
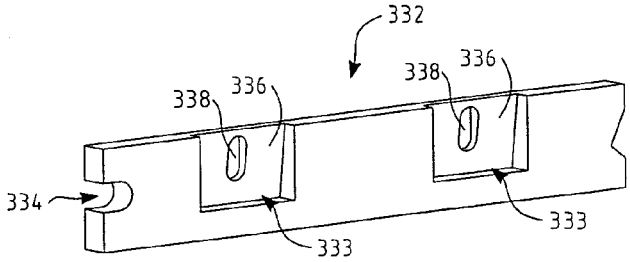

The right hand and left hand fin boxes 302 and 304 respectively of the present embodiment are provided with a left hand removable insert 330 and a right hand removable insert 332 respectively as shown in FIGS. 17, 17B and 17C. Removable inserts 330 and 332 are of a length, width and depth such as to substantially fill recesses 308. With reference to FIGS. 18B and 18C, removable insert 330 and 332 can be provided with a notch 334 at the rearward end of the insert, adapted to releasably engage with the retaining structures 319 of recesses 308. Removable inserts 330 and 332 can be further provided with a pair of receiving recesses 331 and 333 respectively. The length and disposition of recesses 331 and 333 are such that when the inserts are inserted into the respective recesses 308 of right hand fin box 304 and left hand fin box 302, the receiving recesses coincide with sloping wall sections 309. Inner walls 336 of receiving recesses 331 and 333 are provided with slots 338 to allow set screws 339 driven through angled threaded holes 313 to pass through the slots 338 and engage with the dual fin-tabs of a dual fin-tab fin.

The inner walls 336 of receiving recesses 331 and 333 slope inwardly with the same degree of slope as that of sloping wall sections 309 of recesses 308, so that with the inserts located in recesses 308 the sloping wall sections 309 are parallel to the inner walls 336 of receiving recesses 331 and 333. The separation between these opposing parallel walls conforms to the thickness of the dual fin-tabs 42A and 42B of FIG. 3. As can be seen in the sectioned views of FIGS. 17B and 17C, since these dual fin-tabs are in-line with the median plane 340 of the fins 342, the fins 342 assume an outwardly canted angle relative to the underside surface 322. Thus a dual fin-tab fin inserted into right hand fin box 304 fitted with removable insert 332, is canted towards the right hand side of a surfboard, while an identical fin likewise inserted into the left hand fin box 302 and its associated removable insert 330, is canted towards the left hand side of the surfboard.

With reference now to FIGS. 17 and 17A, the recess 308 of center fin box 300 is not provided with sections of sloping walls; opposing sidewalls being parallel and vertical relative to the underside 322 of a surfboard. The center fin box 300 is also provided with two angled threaded holes 317 spaced apart and located along the length of the recess as are the threaded angled holes 313 of the right hand and left hand fin boxes, but disposed one on either side of recess 308.

Center fin box 300 is also provided with a removable insert 350 (shown in FIG. 18A) of similar outward configuration and dimensions as the removable inserts 332 and 330 for the right hand and left hand fin boxes described above. Removable insert 350 is also provided with receiving recesses 352 sized and positioned along the length of the insert as are the receiving recesses 333 and 331 of the right hand and left hand inserts. However, the rear walls 354 of these recesses are not sloping, so that when the insert 350 is inserted into recess 308 of the center fin box, the recesses form parallel sided and vertically disposed recesses. Thus a dual fin-tab fin installed in the center fin box 300 with its removable insert 350, will be vertical relative the underside 322 of a surfboard. Because of the arrangement of the angled threaded holes of the center fin box, only the rear wall 354 of the rearward receiving recess need be provided with a slot 356 for a securing set screw to pass through.

Figure 19:
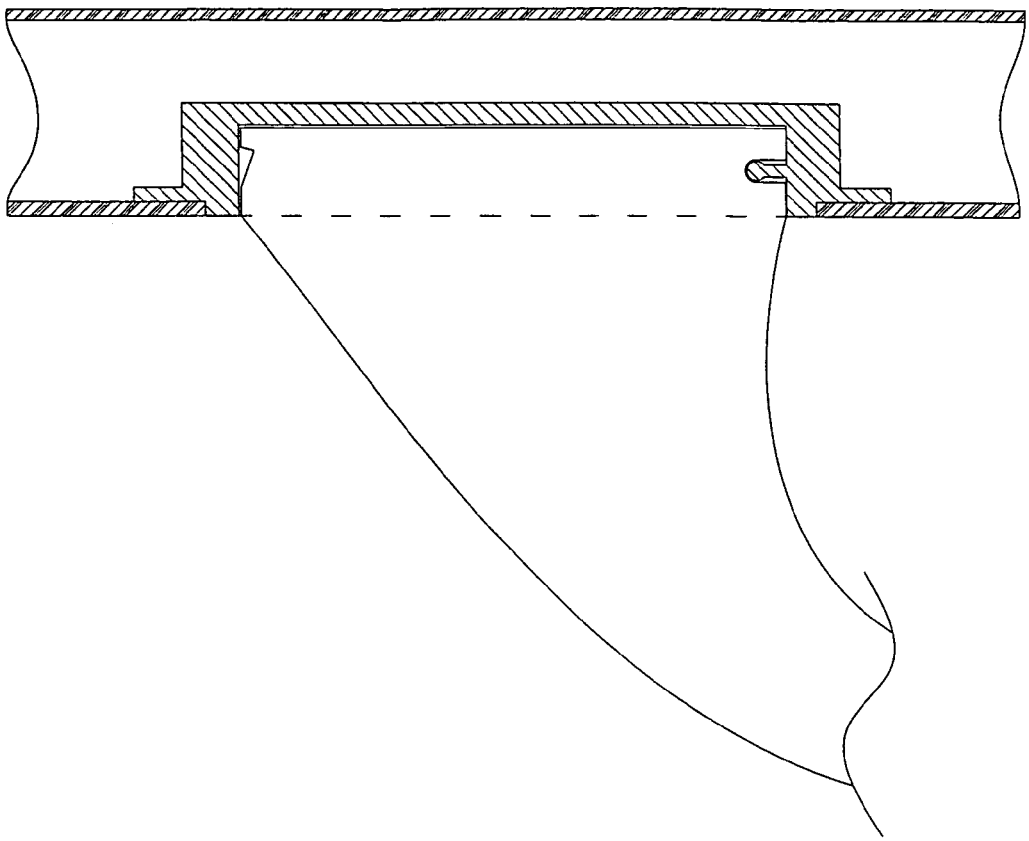
FIG. 19 is a sectioned side elevation view of one of the fin boxes of FIGS. 17 and 17A to 17C without an insert and with a fin with the fin-tab of FIG. 3C installed.

With the respective inserts 332, 350 and 330 of the right hand, center and left hand fin boxes removed, the fin boxes can receive a fin-tab configuration of the type shown as "C" in FIG. 3, as can be seen in FIG. 19. For the right hand and left hand fin to be canted outwardly to the right and left hand sides of a surfboard respectively, fin-tabs canted relative to the plane of the fin as shown in FIG. 11D can be used.

In an alternative arrangement with reference to FIGS. 13A, 14A, 17D to 17H and 18D to 18G, the configuration and dimensions of the finboxes and associated inserts differ from those of FIGS. 17, 17A to 17C and 18, 18A to C. High performance thinner surfboards are weight sensitive, so it is desirable to reduce the overall depth and weight of the finboxes 380, 382, 384 and 390, and avoid weakening the foam core of the board. This is achieved by reducing the depth of the inserts and the finboxes, removing the retaining structure 32 and the front screw hole 35 as shown in FIGS. 17G, and 18D to G.

Figure 13A:
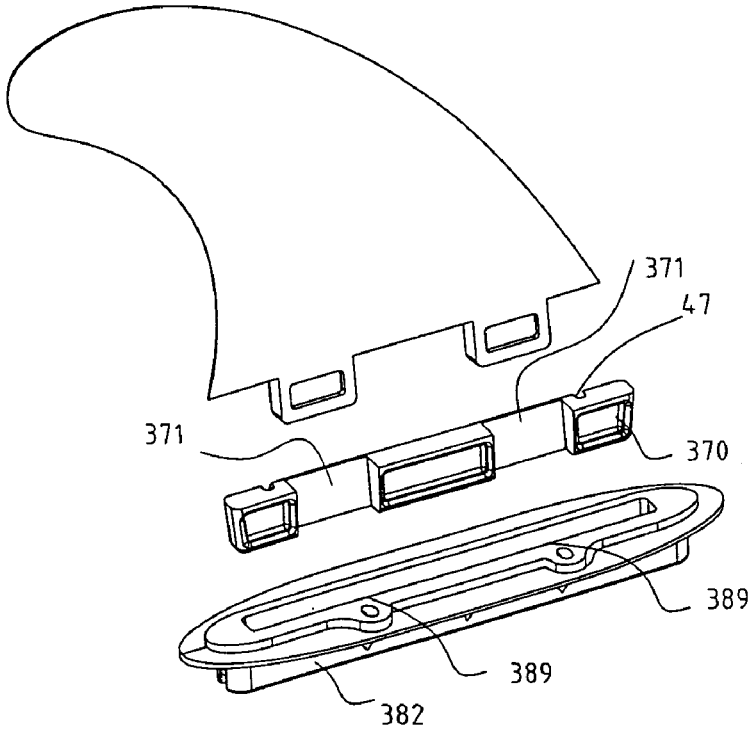
FIG. 13A is a perspective view of an alternative lightweight insert and finbox.
Figure 14A:
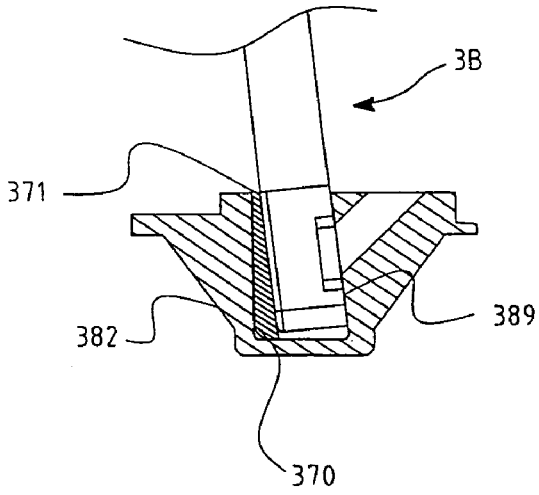
FIG. 14A is a sectioned view of a fin inserted in the fin box and insert of FIG. 13A.

The right hand fin box 384 and the left hand fin box 382 (as shown in FIG. 13A) are each provided with two inwardly sloping wall sections 389. Inwardly sloping wall sections 389 of fin boxes 382 and 384 in this embodiment, slope towards the left hand out-side rail and right hand out-side rail respectively of a surfboard. The length and disposition of sloping wall sections 389 conforms to the length and spacing of the dual fin-tabs 42A and 42B of the fin-tab configuration "B" of FIG. 3. Provided adjacent each sloping wall section 389 is an angled threaded hole 313 passing from first outer surface 316 to the adjacent sidewall of recess 368.

Figure 18G:
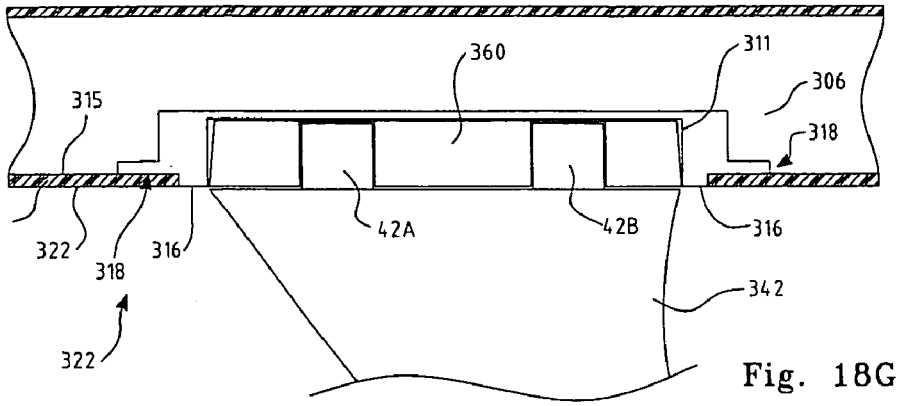
FIG. 18G is a sectioned side elevation view of one of the fin boxes of FIGS. 17D, 17E, 17F, or 17H with a dual fin-tab fin installed together with lightweight insert.
Figure 18D:
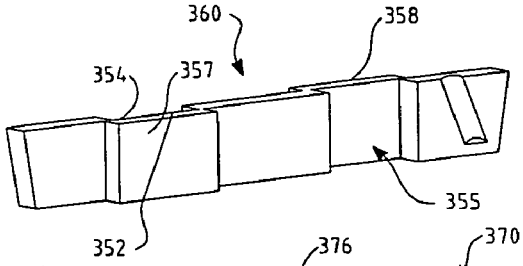
FIGS. 18D, 18E 18F and 18H are detailed perspective views of inserts for the center, left and right hand fin boxes of FIGS. 17D, 17E 17F and 17H.
Figure 18E:
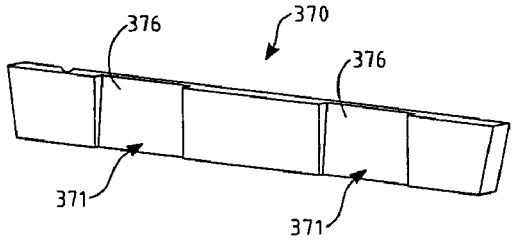
Figure 18F:
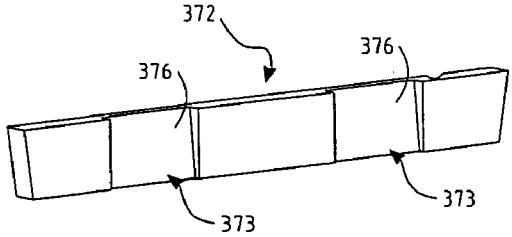

Still with reference to FIGS. 17E and 17F, the right hand and left hand fin boxes 384 and 382 respectively of the present embodiment are provided with a left hand removable insert 370 and a right hand removable insert 372 respectively as shown in FIGS. 18E to 18G. Removable inserts 370 and 372 are of a length, width and depth such as to substantially fill recesses 368.

With reference to FIGS. 18E and 18F, removable insert 370 and 372, are adapted for the recesses with inwardly sloping sections described above and shown in FIGS. 17E and 17F. Removable inserts 370 and 372 are each further provided with a pair of receiving recesses 371 and 373 respectively. The length and disposition of recesses 371 and 373 are such that when the inserts are inserted into the respective recesses 368 of right hand fin box 384 and left hand fin box 382, the receiving recesses coincide with inwardly sloping wall sections 389.

The inner walls 376 of receiving recesses 371 and 373 of FIGS. 18E and 18F, slope outwardly with the same degree of slope as that of inwardly sloping wall sections 389 of recesses 368, so that with the inserts located in recesses 368 the sloping wall sections 389 are parallel to the inner walls 376 of receiving recesses 371 and 373. The separation between these opposing parallel walls conforms to the thickness of the dual fin-tabs 42A and 42B of FIG. 3. As can be seen in the sectioned views of FIGS. 17E and 17F, since these dual fin-tabs are in-line with the median plane 340 of the fins 342, the fins 342 assume an outwardly canted angle relative to the underside surface 322. Thus a dual fin-tab fin inserted into right hand fin box 384 fitted with removable insert 372, is canted towards the right hand out-side rail of a surfboard, while an identical fin likewise inserted into the left hand fin box 382 and its associated removable insert 370, is canted towards the left hand out-side rail of the surfboard.

With reference now to FIG. 17D, the recess 368 of center fin box 380 is not provided with sections of sloping walls; opposing sidewalls being parallel and vertical relative to the underside 322 of a surfboard.

The center fin box 380 shown in FIG. 17D, is also provided with a removable insert 360. The configuration and dimensions of this insert shown in FIG. 18D differ from those of the removable inserts 372 and 370 of the right and left hand fin boxes described above. The external side surfaces of the insert 360, have a pair of offset extensions 357 and 358 which coincide with the location of the pair of recesses 367 and 368 in fin box 380.

Removable insert 360 of FIG. 18D, is also provided with receiving recesses 354 and 355, sized and positioned along the length of the insert as are the receiving recesses 373 and 371 of the right hand and left hand inserts shown in FIGS. 18F and 18E. However, for this embodiment, the recesses are disposed towards opposing sides of the longitudinal axis of insert 360, and the overall depth of the insert is reduced to suit the fin box of FIG. 17D. Also, the rear walls of these recesses are not sloping, so that when the insert 360 is inserted into recess 368 of the center fin box, the recesses form parallel sided and vertically disposed recesses. Thus a dual fin-tab fin installed in the center fin box 380 with its removable insert 360, will be vertical relative the underside 322 of a surfboard, and centrally located relative to the longitudinal axis of recess 368.

In Another version of the center fin box, the fin box 390 has 4 parallel-sided vertical recesses 362, located 2 per side of the recess 368, centrally located about the side securing screws as shown in FIG. 17H, and is also provided with a removable insert 361. The configuration and dimensions of insert 361 shown in FIG. 18H differs from that of the removable insert 360 of center fin box 380 described above. The external side surfaces of the insert 361 have two pairs of offset extensions, 377 and 378 which coincide with the four recesses 379 located on both sides of the recess 368 in fin box 390.

Figure 18H:
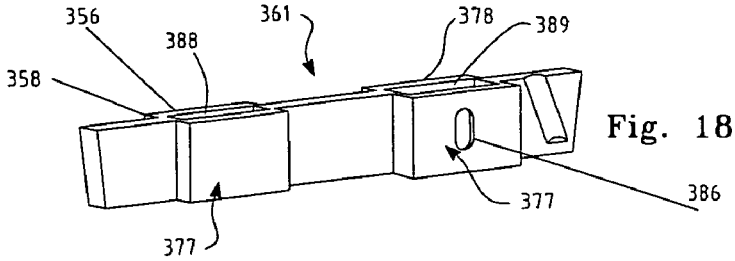

Removable insert 361 of FIG. 18H, is also provided with receiving recesses 388 and 389, sized and positioned along the length of the insert as are the receiving recesses 354 and 355 of the center insert 380 shown in FIG. 18D. However, for this embodiment, the recesses are fully enclosed and centrally disposed along the longitudinal axis of insert 361.

As with insert 360 the overall depth of the insert 361 is reduced to suit the fin box of FIG. 17H. Also, the rear walls of these recesses are not sloping, so that when the insert 361 is inserted into recess 368 of the center fin box 390, the recesses form parallel sided and vertically disposed recesses. Thus a dual fin-tab fin installed in the center fin box 390 with its removable insert 361, will be vertical relative the underside 322 of a surfboard, and centrally located relative to the longitudinal axis of recess 368.

Because of the arrangement of the angled threaded holes of the center fin box 390, the rear side wall 378 and the forward side wall 377 of insert 361 both need to be provided with a slot 386 for the securing set screw to pass through.

With all the respective inserts of the right hand, center and left hand fin boxes removed, the fin boxes can receive a fin-tab configuration of the type shown as "C" in FIG. 3, as can be seen in FIG. 19. For the right hand and left hand fin to be canted outwardly to the right and left hand sides of a surfboard respectively, fin-tabs canted relative to the plane of the fin as shown in FIG. 11D can be used.

The right hand, center and left hand fin boxes of all arrangements of the present embodiment are further able to accommodate and allow fore and aft adjustment of fins with the fin-tab configuration shown in FIG. 12. These fins are provided with fin-tabs specific to right hand, center and left hand fins, with the fin tabs of the right and left hand fins canted relative the blade of the fin so as to set the fin at an outwardly sloping angle relative the underside of the surfboard when the fin-tab is retained between the parallel and vertical opposite walls of the fin box recesses.

Figure 19A:
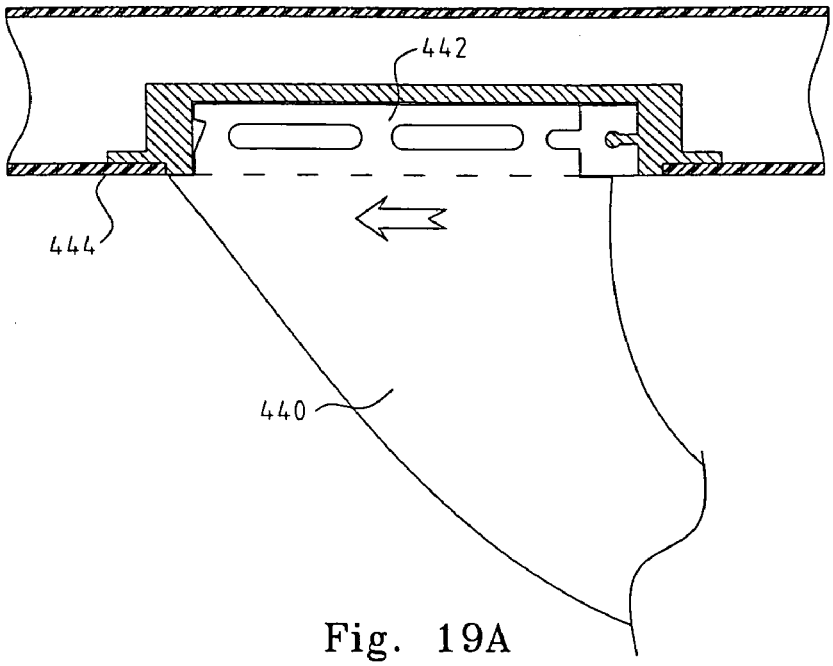
FIGS. 19A and 19B are sectioned views of a fin box with both a recess and base of a fin blade greater in length than the fin-tab of the fin, allowing fore and aft adjustment with the heel or toe of the fin blade extending beyond the fin box recess.
Figure 19B:
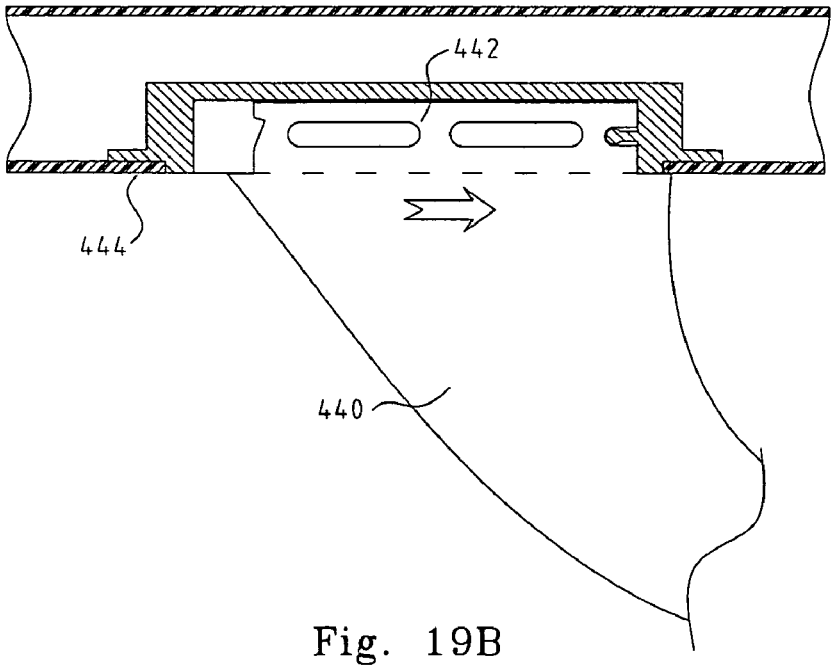

The fore and aft adjustment of this fin-tab configuration is provided by the length of the fin-tab being some 20 mm shorter than the length of the fin box recess. FIGS. 19A and 19B show a fin 440 with a shorter fin-tab 442 in a maximum forward position and a maximum rearward position respectively. The fin-tab 442 is secured in the fin box by the set-screws previously described. As well it will be noted that, regardless of the fin's adjusted fore-aft position, the blade is fully supported on the surface of inner portion 316 and is not in contact with the surface 444 of the surfboard.

Third Preferred Embodiment

Figure 20:
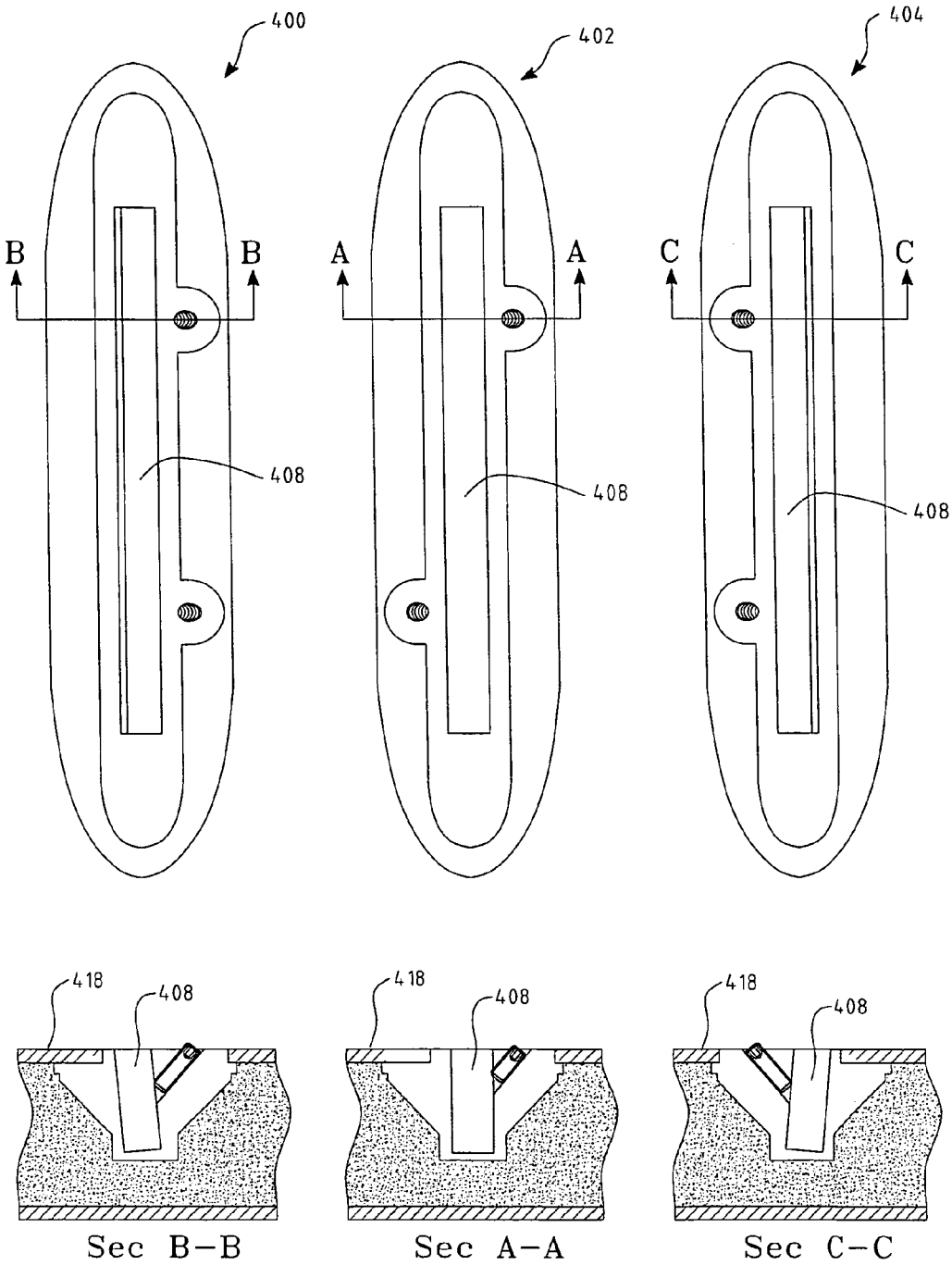
FIG. 20 shows plan and sectioned end elevation views of a further preferred embodiment of a center, left and right fin box according to the invention.
Figure 21:
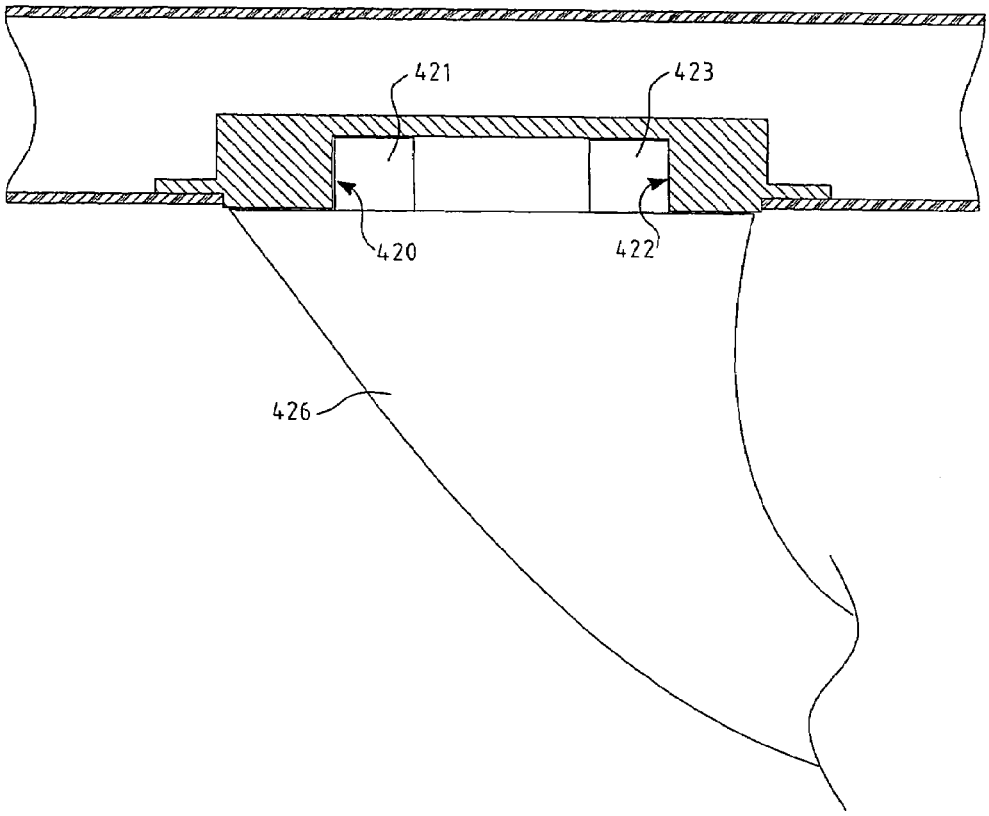
FIG. 21 is a sectioned side elevation view of still a further preferred embodiment of a fin box with a dual fin-tab fin installed.

Turning now to FIGS. 20 and 21, in this further preferred embodiment of the invention, as for the second preferred embodiment described above, a right hand fin box 404, center fin box 402 and a left hand fin box 400 are provided, all with the same general external configuration of the fin boxes of the second preferred embodiment shown in FIG. 17.

Figure 20A:
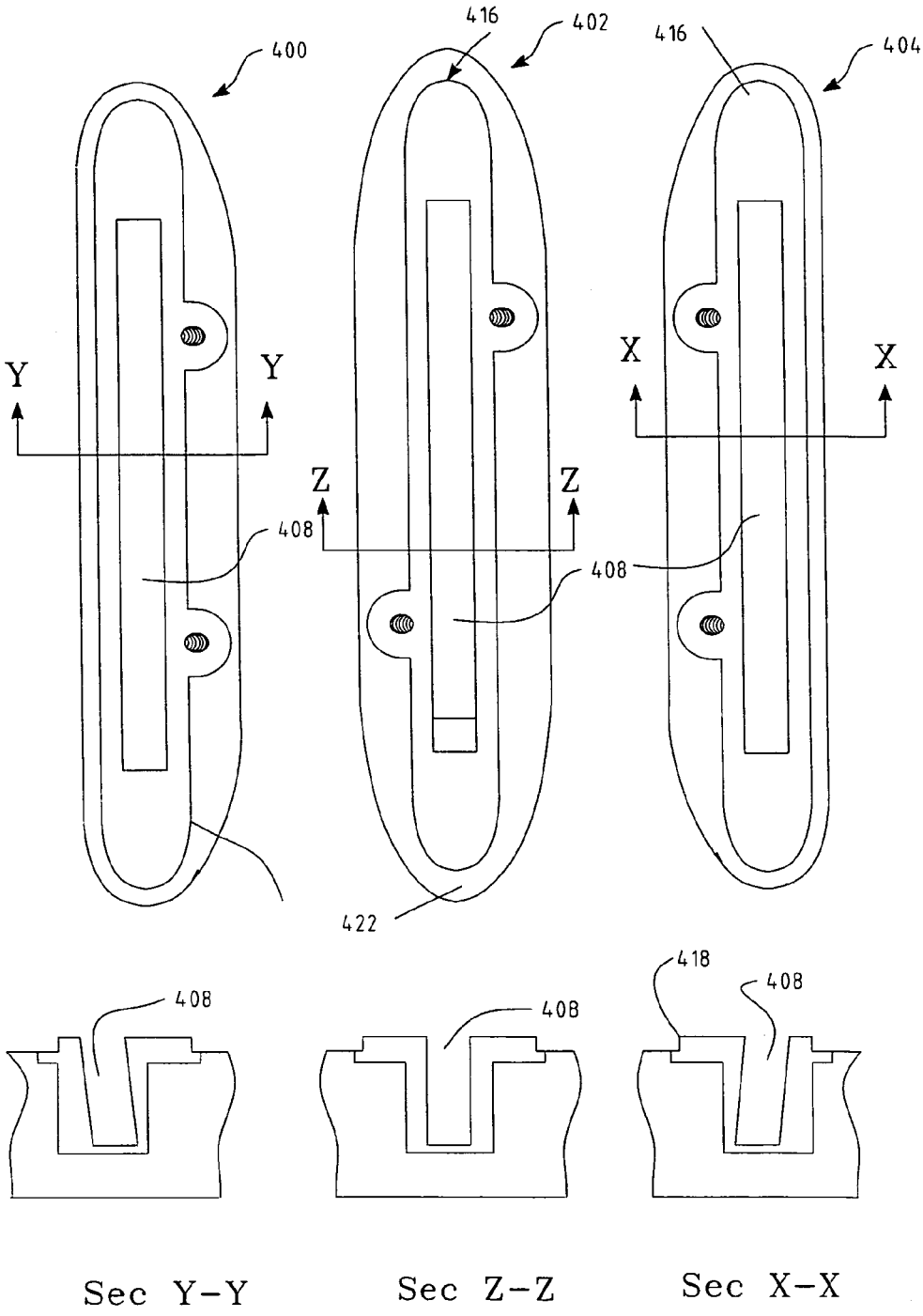
FIG. 20A shows plan and sectioned end elevation views of a further preferred embodiment of a center, left and right fin box incorporating non-symmetrical flanges.

However, in this embodiment, the peripheral flange 420 of left side fin box 400, and the flange 424 of right side fin box 404 have a non-symmetrical profile, so as to provide additional support to the flange area containing the screw holes, and differ from the flange 422 of the center fin box 402 in that they are not axially aligned with the recess 408 or surface 416 of their respective fin boxes, as shown in FIG. 20A.

Additionally, the central recess 408 of each fin box is shortened to a length equal to that from leading edge 420 of the forward fin-tab 421 of a dual fin-tab fin 426, to the trailing edge 422 of the rearward fin-tab 423, as shown in FIG. 21. Also, there is no retaining structure projecting from the rearward end wall of the recess.

For the right hand fin box 404 and the left hand fin box 400, the central recesses 408 have parallel sidewalls canted at an angle to the underside surface 418 of a surfboard, while the sidewalls of the recess of the center fin box are parallel and vertical.

Figure 21A:
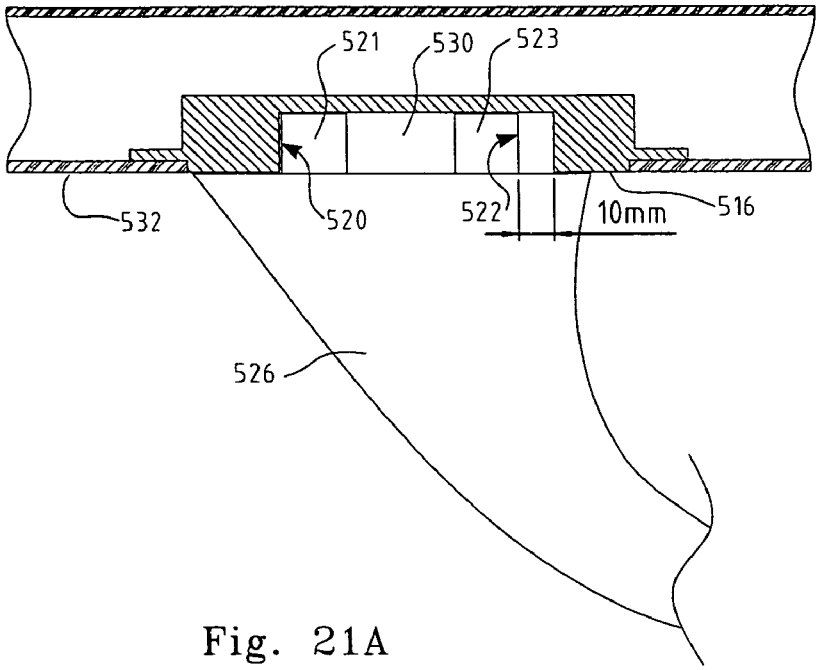
FIGS. 21A and 21B are sectioned side elevation views of a fin with dual fin-tabs installed in a recess of a fin box wherein the recess is of a length allowing fore and aft adjustment of the fin in the fin box.
Figure 21B:
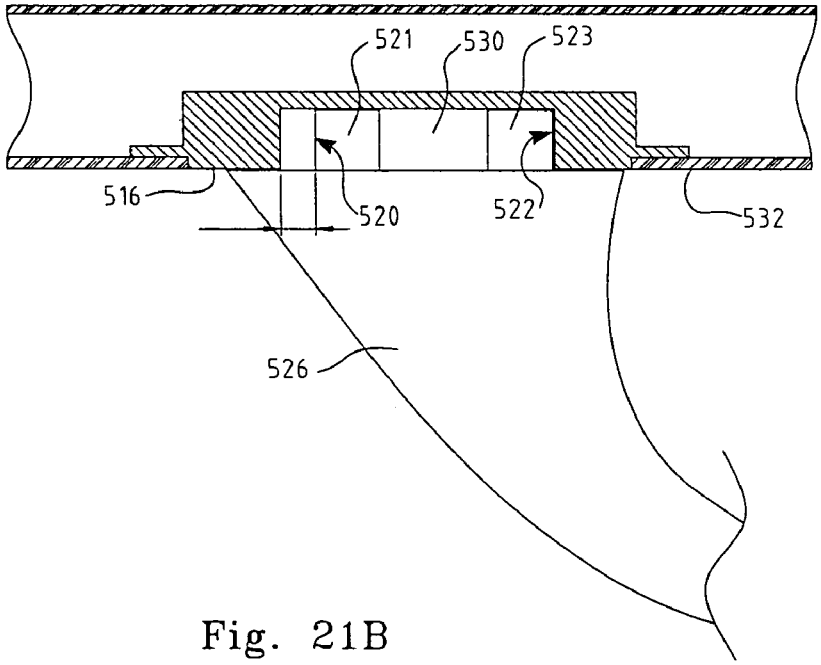

With reference to FIGS. 21A and 21B, fore and aft adjustment of a dual fin-tab fin 526 in the fin boxes may be provided by a recess length longer than the distance between the leading edge 520 of the forward fin-tab 521 and the trailing edge 522 of the rearward fin-tab 523. Thus as shown in FIGS. 21A and 21B, a recess 530, 10 mm longer than the overall length of the dual fin-tabs 521 and 523 will allow the fin 526 to be adjusted plus or minus 5 mm from a median position between the fully forward location of FIG. 21A and the fully rearward position of FIG. 21B. The overall length and breadth of the surface of first outer surface 516 remains such that no part of fin 526 is in contact with the surface 532 of the surfboard.

Figure 21C:
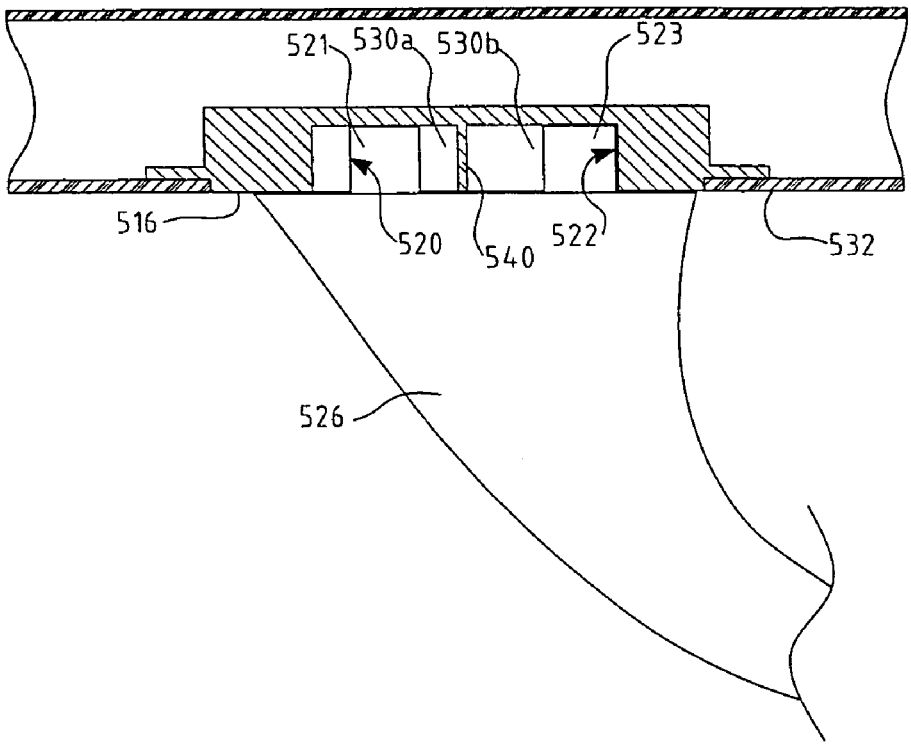
FIG. 21C is a sectioned side view of the fin box of FIGS. 21A and 21B provided with two longitudinally aligned recesses.

In an alternative preferred arrangement, the fin tabs of the fin shown in FIG. 3B, may be accommodated in a modified fin box as shown in FIG. 21C. In this embodiment of a fin box according to the invention, the recess is divided into two sections by divider portion 540, effectively forming two longitudinally aligned recesses 530*a* and 530*b*. The length of divider portion 540 between recess 530*a* and recess 530*b* is such that allowance is made for the fin of FIG. 3B to have a fore-aft adjustment. Thus for example if the length of divider portion 540 is 2 mm and the separation between the forward and rear fin tabs of the fin of FIG. 3B is 12 mm, an adjustment of 10 mm fore and aft is provided for. A further advantage of this particular embodiment of the fin box is that there is a considerable strengthening of the box compared with that of a single continuous recess.

Fourth Preferred Embodiment

Figure 22:
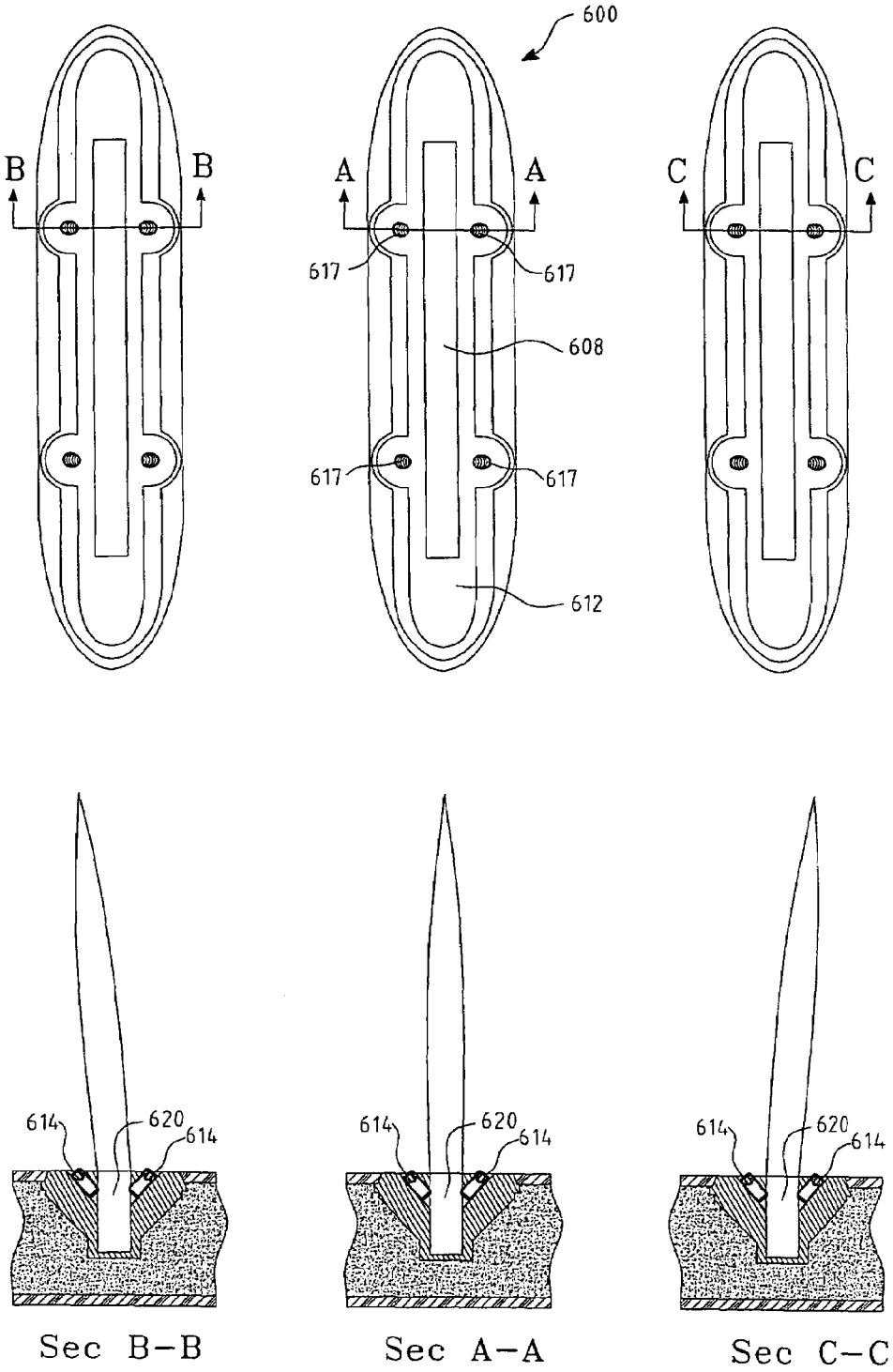
FIG. 22 shows plan and sectioned end elevation views of a further preferred embodiment of a fin box.
Figure 23A:
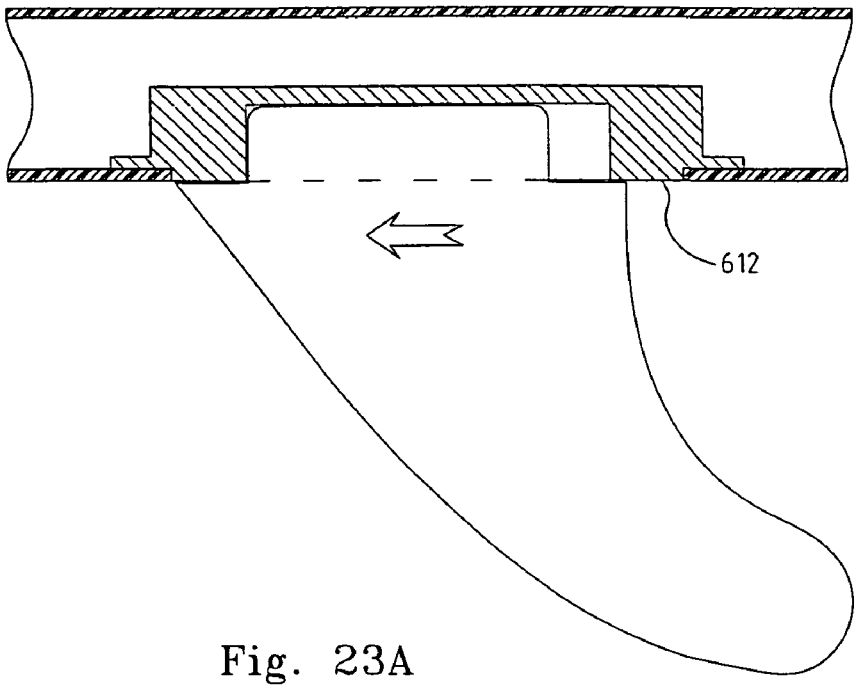
FIGS. 23A and 23B are sectioned side elevation views of a fin with single fin-tab shorter in length to a recess of a fin box allowing fore and aft adjustment of the fin in the fin box.
Figure 23B:
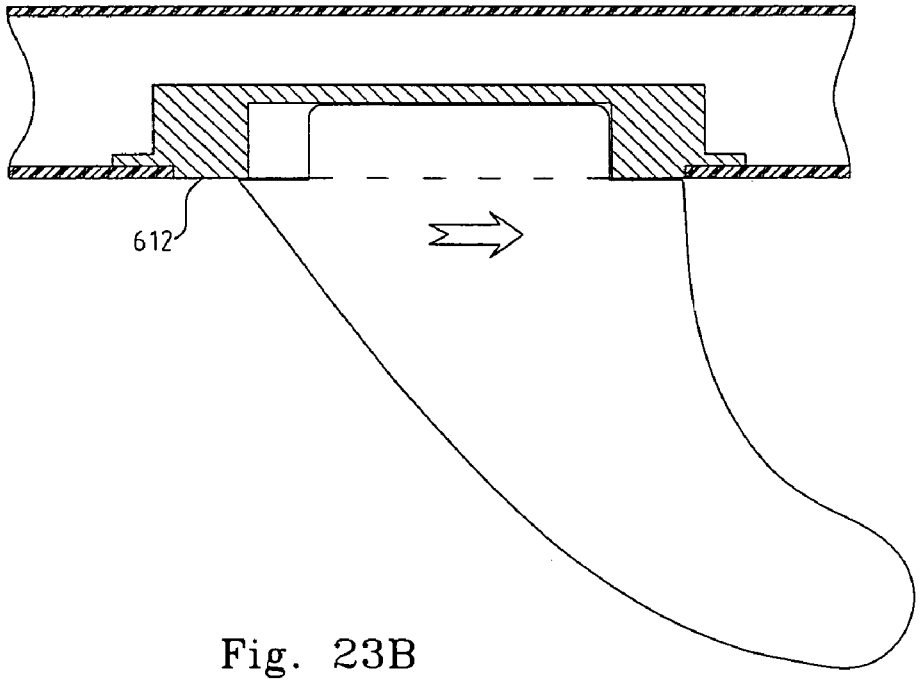

With reference to FIGS. 22 and 23 in a fourth preferred embodiment of the invention, the right hand, center and left hand fin boxes 600 are identical. The external configuration of fin boxes 600 is as previously described for the second and third preferred embodiments above, but the recess 608 is further simplified to a rectangular section recess with opposing parallel side and end walls, normal to the first outer surface 612. In this embodiment each fin box is provided with a pair of angled threaded holes 617 at each side of recess 608, and adapted to receive set screws 614 for the retention of one-piece fin-tabs 620. Threaded holes 617 are coincident with buttress portions.

The fin boxes of this embodiment are adapted for fin-tab configurations where the fin-tab is canted relative to the median plane of the fin for the right hand and left hand fins of a three-fin arrangement.

Fifth Preferred Embodiment

Figure 25:
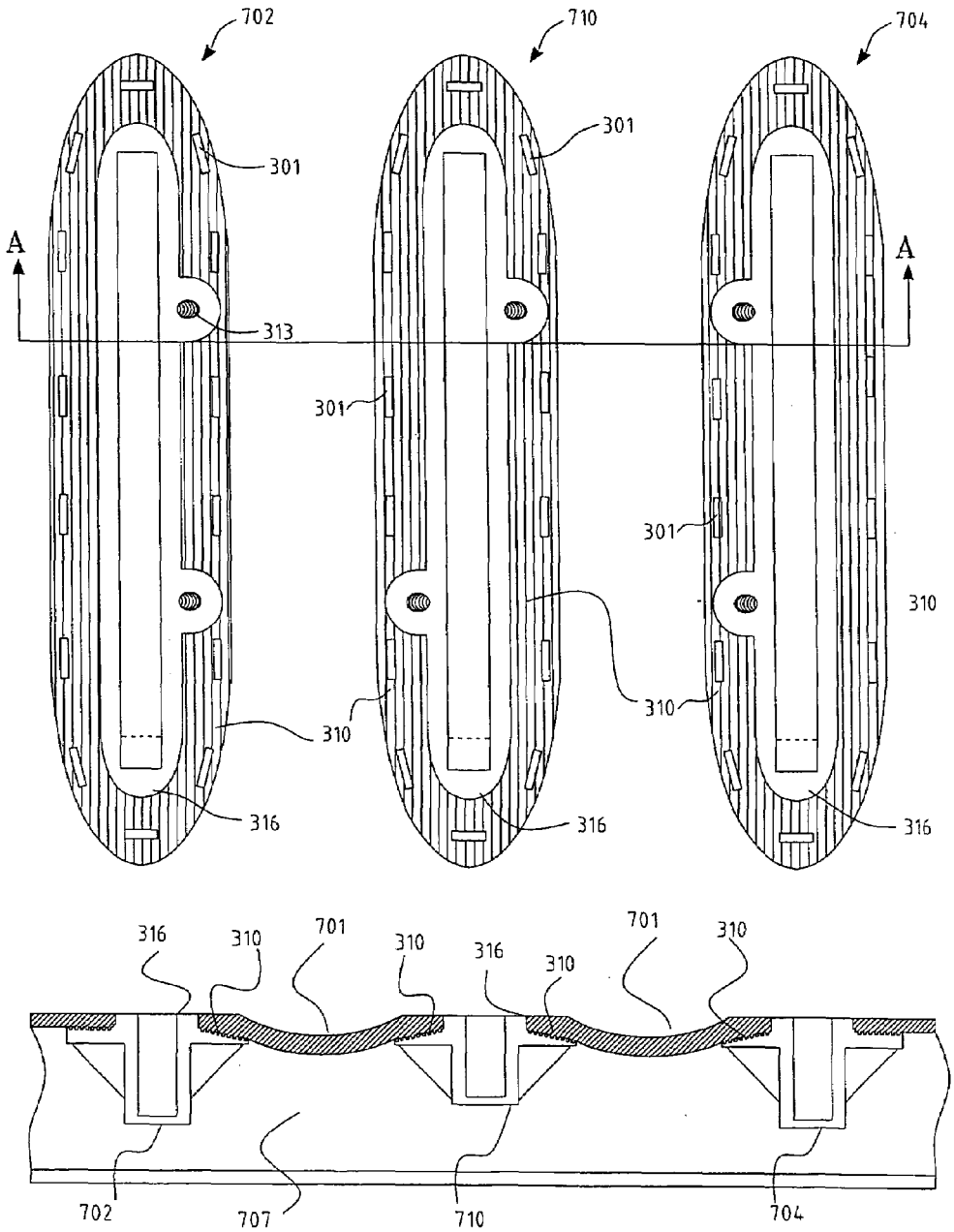
FIG. 25 shows plan and end views of a further preferred embodiment of a left, right and center fin box with tapered flanges, inserted in a water craft fitted with concave channels.

A feature particularly of high performance surf boards is that the underside surface of the board is provided with scalloped channels 701 between the center fin 17 and the two side fins 15 and 16. These concave formations cause the surfaces immediately adjacent the two opposing sides of the center fin box first outer surface 316 (see FIGS. 24 and 25), and the inside edges of the outer surfaces 316 of the left and right hand fin boxes, to protrude through the fiberglass surface of the body of the board. To eliminate this situation, both sides of the peripheral flange 310 of the central fin box 710 are angled away from surface 316, so as to ensure that the flange remains under the outer skin of the board. Similarly, the inward facing portions of the flanges 316 of the left hand and right hand fin boxes 702 and 704 are also angled away from surface 316, whilst the outward facing portions of the flanges 316 remain flat.

The fin boxes of the present invention may be incorporated in the body of a surfboard in accordance with known processes. That is the board may be completely-finished to the glassed stage, after which suitable recesses are machined through the glassed surface and into the foam of the core. The boxes are then inserted and retained with a suitable bonding agent, or another small section of glass cloth localized to cover the fin box.

Figure 26:
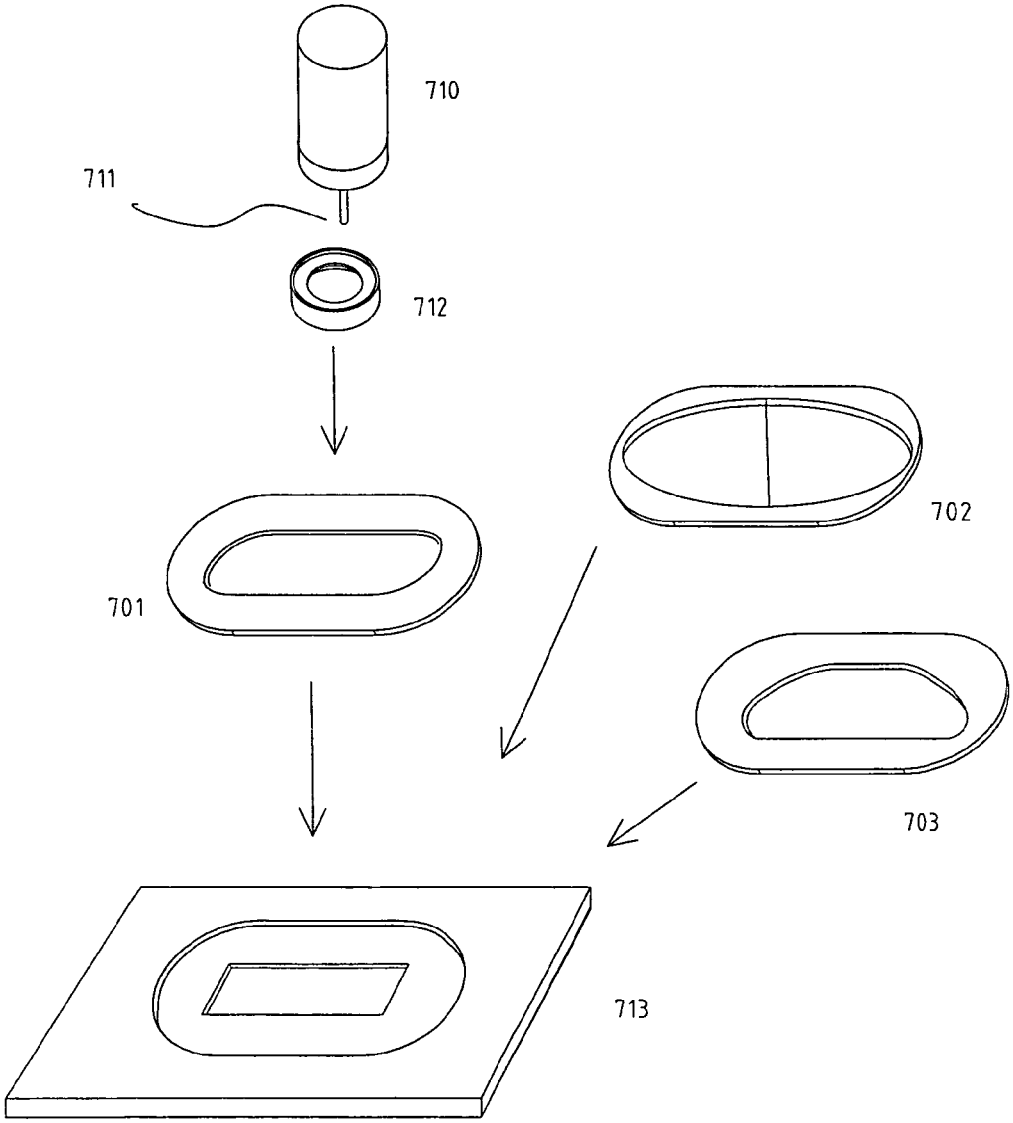
FIG. 26 is a perspective view of installation equipment utilizing multiple templates to produce specific cavities to enable the installation of finboxes of the preferred embodiment into a water board.
Figure 27:
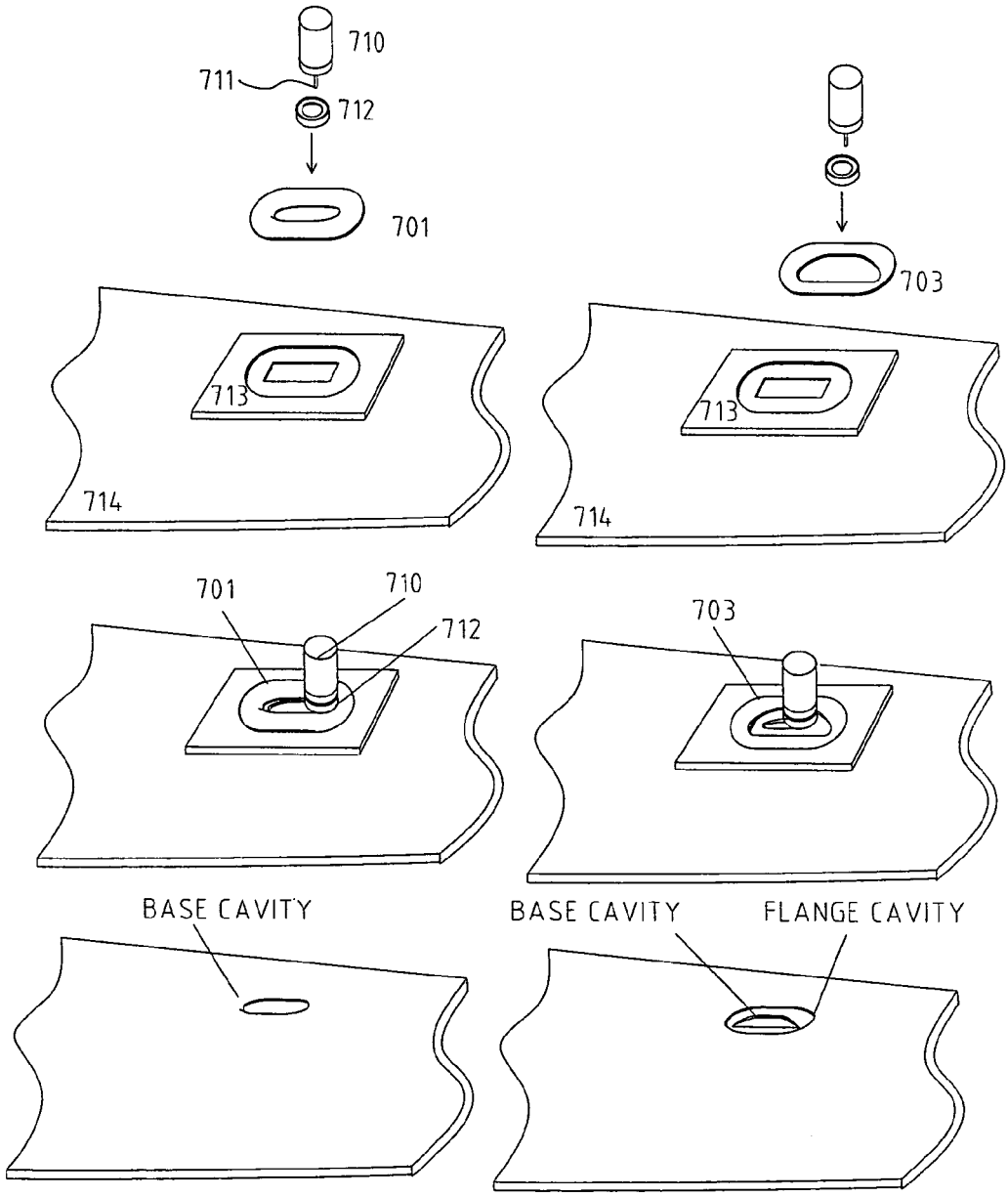
FIG. 27 is a further perspective view of installation equipment required to produce dual profile cavities of a non-symmetrical nature.

Alternatively, a cavity may be formed in the foam core and the box inserted prior to glassing. An improved method for creating a multi-level cavity is with the use of a multiplicity of cutting templates such as templates 701 and 702, that independently create the various levels and profiles of the cavities with out having to be concentric or axially aligned as shown in FIGS. 26 and 27.

In this process the rotary cutting device 710 with associated cutter 711, accepts a alignment adapter 712 that is inserted into the first embedded cutting template 701, located in the master alignment plate 713.

The cavity for the base section of the center, left or right side finbox can be machined into the foam 714, using template 701.

By replacing template 701 with other templates 702 or 703, the upper flange section can be machined into the foam 714, for the individual center, left or right finbox, to provide a better structural and aesthetic shape with respect to the securing screws and independent of the shape of the base cavity.

For this process the box may be provided with a projecting barrier 240 so as to prevent resin flowing into the center recess and angled threaded holes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for releasable attachment of a fin of a water board, said method including:

(a) providing at least a fin box embedded in said water board, said fin box comprising an elongate body with a recess longer than a length of a portion of the fin to be inserted into the recess, said recess open at a first surface if the elongate body, and said fin box further including a flange extending outwardly from the elongate body and proximate to the first surface, a buttress extending from the flange to a side of the elongate body and an angled threaded hole extending through the first surface, the buttress and the side of the elongate body, (b) withdrawing a screw provided in the angled threaded hole in said fin box to allow insertion of said portion of the fin into said recess, (c) adjusting the fin forward or aft in the recess to position the portion of the fin in the recess;

(d) driving said screw into contact with the portion of the fin while said fin is in the recess.

2. A fin box for a water board, said fin box comprising:

a generally elongate body provided with a substantially elongated recess open at a first surface of said body;

a peripheral flange extending outwardly from said elongate body at said first surface;

a buttress along at least one side of said elongate body, the buttress forming a projecting abutment between said flange and said at least one side of said elongate body;

an angled hole extending through the flange, the buttress and the side of said elongate body, and a shaft seated in the angled hole and adapted to abut a side of a fin inserted in the recess of the fin box, wherein the shaft secures the fin to the fin box when seated in the angled hole and abutting the fin.

3. A fin box as in claim 2 wherein the peripheral flange is at least partially recessed below a finished bottom surface of the water board when the fin box is mounted in the water board.

4. A fin box as in claim 2 wherein the angled hole has threads to receive threads on the shaft.

5. A fin box as in claim 2 further comprising a removable insert having an outer shape adapted to fit snugly in the recess and having a receiving surface adapted to receive a first type of fin, wherein the insert further comprises an opening which is aligned with the angled hole when the insert is in the recess to allow the shaft to abut against the first type of fin.

6. A fin box for a water board, said fin box comprising:

a generally elongate body provided with a substantially elongated recess open at a first surface of said body, wherein the recess is adapted to receive an end portion of a fin;

a peripheral flange extending outwardly from said elongate body at said first surface;

a buttress along a side of said elongate body, the buttress extending between the flange and the side of said elongate body;

an angled hole extending through the first surface, the flange, the buttress and the side of said elongate body, and a shaft seated in the angled hole and adapted to abut a side of an fin inserted in the recess of the fin box, wherein the shaft secures the fin to the fin box and water board when seated in the angled hole and abutting the fin.

7. A fin box as in claim 6 wherein the elongated recess is substantially longer than the end portion of the fin to allow the fin to be positioned for and aft in the recess before the shaft secures the fin to the fin box.

8. The fin box of claim 6 adapted to form at least one of: a right hand fin box for retaining a fin at a right hand side of said water board and a left hand fin box for retaining a fin at a left hand side of said water board, and wherein at least one side wall of said recess of each of said fin box is provided with at least a portion of an outwardly sloping wall section.

9. The fin box of claim 6 wherein said fin box is of a length and width sufficient to support said fin entirely so that no portion of said fin is in contact with said body of said water board.

10. The fin box of claim 6 wherein said fin box further comprises a peripheral flange to be seated in a bottom surface of the board.

11. The fin box of claim 10 further comprising a buttressing rib extending between the peripheral flange and an outer sidewall of the body.

12. A fin box as in claim 6 wherein the peripheral flange is substantially orthogonal to the recess in the fin box and the buttress is a triangular section substantially orthogonal to the recess and the flange.

13. A fin box as in claim 6 wherein the peripheral flange is at least partially recessed below a finished bottom surface of the water board when the fin box is mounted in the water board.

14. A fin box as in claim 6 wherein the angled hole has threads to receive threads on the shaft.

15. A fin box as in claim 6 further comprising a removable insert having an outer shape adapted to fit snugly in the recess and having a receiving surface adapted to receive a first type of fin, wherein the insert further comprises an opening which is aligned with the angled hole when the insert is in the recess to allow the shaft to abut against the first type of fin.

16. A method for releasable attachment of a fin to a water board, wherein the water board includes an embedded fin box having an elongate body with at least one elongated recess open at a first surface of the body, a flange extending outwardly from said elongate body, a buttress between the flange and a side of the elongate body and an angled hole extending through the first surface, the flange, the buttress and the side, the method comprising:

inserting an attachment portion of the fin into the recess in the fin box;

adjusting the fin relative to the board by shifting the attachment portion forward or aft in the at least one elongated recess of the fin box;

inserting a rod into the angled hole, whereby the rod moves sequentially through the flange, buttress and the side of the elongate body, and securing the fin in the fin box by advancing the rod in the angled hole to apply a bias force between a distal end of the rod and the attachment portion of the fin, wherein the bias force prevents forward and aft movement of the fin in the fin box.

17. The method of claim 16 wherein the rod includes at least one set-screw and:

the step of adjusting the fin includes retracting the at least one set-screw provided in the angled hole, wherein the angled hole is threaded and the set-screw is retracted a distance sufficient to allow insertion of the attachment portion of the fin into the recess, and the step of securing the fin includes advancing the set-screw into contact with the attachment portion of the fin inserted in the fin box.

18. The method of claim 16 wherein the recess is elongated in a direction generally parallel to a longitudinal axis of the water board, and the recess is narrow in a direction perpendicular to the longitudinal axis of the board and wide along the longitudinal axis, and wherein:

the adjustment step includes sliding the attachment portion of the fin forward or aft along the longitudinal axis, and the securing step includes advancing the rod into contact with the attachment portion along the direction perpendicular to the longitudinal axis.

19. The method of claim 16 wherein the attachment portion of the fin includes at least one fin tab and the adjusting step includes sliding the at least one fin tab forward or aft in the recess of the fin box.

20. The method of claim 16 wherein the attachment portion of the fin includes a plurality of fin tabs and:

the adjusting step includes sliding the fin tabs forward or aft in the recess of the fin box, and the securing step includes advancing a plurality of rods each extending through a respective one of an angled hole and each rod biases against a respective one of the fin tabs.

21. A method for releasable attachment of a fin to a water board, wherein the water board includes an embedded fin box, the method comprising:

embedding a fin box with an elongated recess in a board surface said water board such that a peripheral flange extending outwardly from said elongate body is adjacent the board surface and a buttress rib extending between the flange and a side of the elongate body extends into the water board in a direction generally perpendicular to the board surface;

after embedding the fin box, inserting rod into an angled hole wherein the angled hole extends through the flange, the buttress and the side of the elongate body to open to the recess;

inserting an insert into the recess;

inserting an attachment portion of the fin in the recess of the fin box, wherein at least a portion of the insert is sandwiched between the attachment portion and an inner sidewall of the recess;

longitudinally moving the fin in the fin box, while the shaft is not securing the attachment portion to the fin box, and securing the fin in the fin box by advancing the rod in the angled hole to bind the attachment portion and the insert against the sidewall.

22. The method of claim 21 wherein longitudinally moving the fin includes sliding the attachment portion forward or aft with respect to the fin box when the insert is inserted in the recess and while the insert is held by the rod to prevent forward and aft movement of the insert in the recess.

23. The method of claim 21 wherein the angled hole includes a pair of angled holes extending through buttresses on opposites sides of the recess, and securing the fin includes advancing the rod in each of the angled holes to bind the attachment portion from opposite sides of the recess.

24. The method of claim 21 wherein securing the fin includes supporting the attachment portion of the fin with the insert to minimize movement of the attachment portion in a direction perpendicular to a longitudinal axis of the fin box.

25. A fin box for a water board comprising:

an elongate body having an elongated recess open at a first surface of said body, wherein the recess is adapted to receive an end portion of a fin and the recess is substantially longer than the end portion of the fin;

a peripheral flange extending outwardly from said elongate body at said first surface, at least one buttress on a side of elongate body wherein the buttress forms a projection abutment between the flange and the side of said elongate body;

an angled hole extending through the flange, the buttress and the side of said elongate body to emerge at the recess, and a shaft seated in the angled hole and adapted to abut a side of the end portion of the fin inserted in the recess of the fin box, wherein the shaft secures the fin to the fin ox and the water board when seated in the angled hole and abutting the fin, and an insert releasably secured in the elongated recess, said insert having a first side abutting an inner side wall of the elongated recess and a second side adapted to abut a side of the end portion of the fin.

26. The fin box for a water board as in claim 25 wherein the insert includes an opening through which the shaft extends.

27. The fin box for a water board as in claim 25 wherein the insert includes a sidewall and a thickness of the sidewall is tapered such that, while the end portion of the fin abuts the insert, the fin slants in the water board.

28. The fin box for a water board as in claim 25 wherein the insert is selected from a group including:

a first insert having vertical parallel sidewalls adjacent a sidewall surface adapted to abut the attachment portion of the fin, and a second insert having at least one vertically tapered sidewall adjacent a sidewall surface adapted to abut the attachment portion of the fin.

29. A fin box for a water board comprising:

a generally elongate body provided with a substantially elongated recess open at a first surface of said body, wherein the recess is adapted to receive an end portion of a fin, said recess is substantially longer than the end portion of the fin;

a peripheral flange extending outwardly from said elongate body at said first surface;

at least one buttress on a side of elongate body extending between the side and the flange;

an angled hole extending through the flange, the buttress and the side of said elongate body, and a shaft seated in the angled hole and adapted to abut a side of the end portion of the fin inserted in the recess of the fin box, wherein the shaft secures the fin to the fin box and the water board when seated in the angled hole and abutting the fin;

at least one sidewall of the elongated recess having a tapered portion to slant the attachment portion of the fin outwardly toward an outside rail of the water board;

an angled hole extending through the first surface and a side of said elongate body, and a shaft seated in the angled hole and adapted to abut a side of a fin inserted in the recess of the fin box, wherein the shaft advances through the angled hole and abuts the side of the attachment portion of the fin located within the sloping portion of the recess.

* * * * *